US011326626B2

(12) United States Patent
Lerner et al.

(10) Patent No.: US 11,326,626 B2
(45) **Date of Patent: *May 10, 2022**

(54) PRIME MOVER SYSTEM AND METHODS UTILIZING BALANCED FLOW WITHIN BI-DIRECTIONAL POWER UNITS

(71) Applicant: AOI, Stafford, TX (US)

(72) Inventors: Daniel Maurice Lerner, Missouri City, TX (US); Andre Orban, Sugarland, TX (US); Ranjit Singh, Houston, TX (US)

(73) Assignee: AOI, Stafford, TX (US)

( * ) Notice: Subject to any disclaimer, the term of this patent is extended or adjusted under 35 U.S.C. 154(b) by 15 days.

This patent is subject to a terminal disclaimer.

(21) Appl. No.: 16/786,067

(22) Filed: Feb. 10, 2020

(65) Prior Publication Data

US 2020/0277972 A1 Sep. 3, 2020

Related U.S. Application Data

(62) Division of application No. 15/331,343, filed on Oct. 21, 2016, now Pat. No. 10,598,193.

(Continued)

(51) Int. Cl.
*F15B 15/17* (2006.01)
*F15B 7/00* (2006.01)

(Continued)

(52) U.S. Cl.
CPC ..... *F15B 7/10* (2013.01); *F03C 1/06* (2013.01); *F04B 1/12* (2013.01); *F04B 23/021* (2013.01);

(Continued)

(58) Field of Classification Search
None
See application file for complete search history.

(56) References Cited

U.S. PATENT DOCUMENTS 2,927,429 A * 3/1960 Carlson ..... E05F 15/50 60/465
3,163,791 A 12/1964 Carlson (Continued)

FOREIGN PATENT DOCUMENTS

CN 2865216 2/2007
CN 102887432 A 1/2013

(Continued)

*Primary Examiner* — Michael Leslie
(74) *Attorney, Agent, or Firm* — ePatentManager.com; Guerry L. Grune

(57) ABSTRACT

Systems, methods and devices are described providing a selective hydraulic or electrically powered prime mover that is a bi-directional power unit system, including movement within a device used to compress and/or expand a fluid and provide fluid movement. The use of a hydraulic power unit is involved and comprises at least a pump or other fluid moving device, a first set of selective control valves delivering pressurized fluid to the device(s), and a second set of selective control valves returning unpressurized fluid from the device(s), a reservoir comprising a compensator tank, a port for operation at ambient pressure, and a pressure measuring device measuring ambient pressure allowing for unbalanced flow to and from the device as well as thermal expansion or compression. The use of a multiport and in some cases a swashplate pump that incorporates the features and functions of several valves for the system is also described.

38 Claims, 25 Drawing Sheets

Related U.S. Application Data

(60) Provisional application No. 62/245,510, filed on Oct. 23, 2015.

(51) Int. Cl.

| | |
|---|---|
| ***F15B 1/26*** | (2006.01) |
| ***F15B 7/10*** | (2006.01) |
| ***F15B 19/00*** | (2006.01) |
| ***F03C 1/06*** | (2006.01) |
| ***F04B 27/18*** | (2006.01) |
| ***F04B 1/12*** | (2020.01) |
| ***F04B 49/22*** | (2006.01) |
| ***F04B 23/02*** | (2006.01) |

(52) U.S. Cl.

CPC ..... *F04B 27/1804* (2013.01); *F04B 49/22* (2013.01); *F15B 1/26* (2013.01); *F15B 7/006* (2013.01); *F15B 15/17* (2013.01); *F15B 19/005* (2013.01); *F15B 1/265* (2013.01); *F15B 2211/20538* (2013.01); *F15B 2211/20561* (2013.01); *F15B 2211/27* (2013.01); *F15B 2211/3052* (2013.01); *F15B 2211/30505* (2013.01); *F15B 2211/7052* (2013.01); *F15B 2211/7053* (2013.01); *F15B 2211/785* (2013.01)

(56) References Cited

U.S. PATENT DOCUMENTS

| | | | | |
|---|---|---|---|---|
| 3,435,614 | A | 4/1969 | Ledeen et al. | |
| 4,077,746 | A * | 3/1978 | Reynolds | F15B 3/00 417/225 |
| 5,109,672 | A * | 5/1992 | Chenoweth | B64C 13/505 60/456 |
| 5,144,801 | A * | 9/1992 | Scanderbeg | F15B 15/18 60/475 |
| 5,473,939 | A | 12/1995 | Leder et al. | |
| 5,536,150 | A | 7/1996 | Tucker | |
| 5,556,263 | A | 9/1996 | Jacobsen et al. | |
| 5,587,525 | A | 12/1996 | Shwe et al. | |
| 5,603,354 | A | 2/1997 | Jacobsen et al. | |
| 5,618,163 | A | 4/1997 | Jacobsen et al. | |
| 5,635,631 | A | 6/1997 | Yesudas et al. | |
| 5,647,575 | A | 7/1997 | Jacobsen et al. | |
| 5,710,401 | A | 1/1998 | Jacobsen et al. | |
| 5,799,690 | A | 9/1998 | Jacobsen et al. | |
| 5,807,075 | A | 9/1998 | Jacobsen et al. | |
| 5,819,574 | A | 10/1998 | Yogo | |
| 5,913,647 | A | 8/1999 | Jacobsen et al. | |
| 5,941,533 | A | 8/1999 | Jacobsen et al. | |
| 5,944,495 | A | 8/1999 | Jacobsen et al. | |
| 6,007,310 | A | 12/1999 | Jacobsen et al. | |
| 6,116,138 | A * | 9/2000 | Achten | F04B 1/2042 417/225 |
| 6,225,706 | B1 | 5/2001 | Keller | |
| 6,470,678 | B1 * | 10/2002 | Huber | B62D 25/12 60/476 |
| 6,863,502 | B2 | 3/2005 | Bishop et al. | |
| 6,874,343 | B1 | 4/2005 | Ariji | |
| 6,886,331 | B2 | 5/2005 | Joshi | |
| 6,912,849 | B2 * | 7/2005 | Inoue | E02F 9/2228 60/475 |
| 7,155,910 | B2 * | 1/2007 | Last | F15B 7/006 4/502 |
| 7,513,112 | B2 * | 4/2009 | Sato | F15B 7/006 60/475 |
| 7,788,918 | B2 * | 9/2010 | Huber | F15B 11/08 60/475 |
| 7,934,413 | B2 | 5/2011 | Winchester | |
| 8,096,117 | B2 | 1/2012 | Ingersoll et al. | |
| 8,161,741 | B2 | 4/2012 | Ingersoll et al. | |
| 8,196,664 | B2 | 6/2012 | Reid | |
| 8,286,659 | B2 | 10/2012 | Ingersoll et al. | |
| 8,359,857 | B2 | 1/2013 | Ingersoll et al. | |
| 8,522,538 | B2 | 9/2013 | Ingersoll et al. | |
| 8,522,886 | B2 | 9/2013 | Christie et al. | |
| 8,544,264 | B2 * | 10/2013 | Anderson | F15B 21/14 60/475 |
| 8,602,112 | B2 | 12/2013 | Reid | |
| 9,695,841 | B2 * | 7/2017 | Udagawa | E02F 9/2095 |
| 10,598,193 | B2 * | 3/2020 | Lerner | F15B 15/17 |
| 10,871,174 | B2 * | 12/2020 | Lerner | F15B 15/17 |
| 2011/0225962 | A1 | 9/2011 | Landrum | |
| 2011/0319221 | A1 | 12/2011 | O'Brien et al. | |
| 2013/0139900 | A1 | 6/2013 | Lewis | |
| 2014/0190152 | A1 | 7/2014 | Ingersoll et al. | |
| 2014/0318113 | A1 | 10/2014 | Harsia et al. | |

FOREIGN PATENT DOCUMENTS

| | | | |
|---|---|---|---|
| CN | 203532369 | | 4/2014 |
| CN | 103817969 | A | 5/2014 |
| CN | 104121142 | A | 10/2014 |
| DE | 19541220 | C1 | 3/1997 |
| GR | 20050100396 | A | 1/2007 |
| KR | 101052296 | B1 | 7/2011 |
| RU | 2128789 | | 4/1994 |
| RU | 2108507 | C1 | 4/1998 |
| RU | 5416745 | C1 | 4/2011 |
| SU | 1141215 | A | 2/1985 |

* cited by examiner

PRIME MOVER SYSTEM AND METHODS UTILIZING BALANCED FLOW WITHIN BI-DIRECTIONAL POWER UNITS

PRIORITY

This application is a divisional of and claims priority under 35 USC 120 from U.S. application Ser. No. 15/331,343 filed Oct. 21, 2016 and entitled "Prime Mover System and Methods Utilizing Balanced Flow within Bi-Directional Power Units", which is a non-provisional conversion of and claims priority under 35 USC 119 from Provisional Application 62/245,510 filed Oct. 23, 2015 and entitled "Prime Mover System and Methods Utilizing Bi-Directional Power Units", the entire contents of which are hereby incorporated by reference.

BACKGROUND OF THE INVENTION

The invention relates generally to systems and methods that include powered units (power units—PUs, and most often hydraulic power units—HPUs) designed for operating "prime movers". These systems utilize devices that move by receiving hydraulic and/or electric power and are primarily associated with pipelines. Although the prime movers described herein in detail have been designed specifically for downhole petrochemical well applications, the assemblies and associated valve operation and engagement with actuated hydraulic cylinders and pistons pose opportunities for optimizing the actuation and efficiencies in other applications. These applications include other technology fields involving; energy generation, distribution, and storage, including cogeneration, hydraulic power systems, air and water reclamation systems, as well as transportation systems including civilian and military automobiles, aircraft, and ships. The valve operations for the "prime movers" include the use of selective bi-directional hydraulic/electric power unit (HPU's) where the hydraulic fluids can be air, gas, or liquid.

SUMMARY OF THE INVENTION

Systems, methods, and devices for optimizing bi-directional movement of (mostly) mechanical devices including pistons, motors, pumps, gears, valves, packers, as well as other mechanical devices that require automated movement as required using compression and/or expansion of fluids such as air, gas or hydraulic fluids are described herein. The system(s) can be powered by hydraulic power, electrical power, or a combination of both.

Unbalanced flow has been an historical issue for any sealed system that is required to move fluid in either a singular or bidirectional manner. The primary reason this problem has existed is because the fluid moving system will experience hydraulic lock when a different amount of flow going into the prime mover (such as a pump/motor) is required versus the flow that is being sent out of the prime mover.

A common desirable application for utilizing a prime mover to move a hydraulic system is to connect the prime mover inlet to an inlet port side of a hydraulic cylinder and connect the outlet side of the prime mover to the outlet port side of the hydraulic cylinder. The requisite action is that during operation, the prime mover pushes fluid out of the prime mover cavity and into an inlet port side of the hydraulic cylinder, thereby moving a piston or other moving parts of the hydraulic cylinder. The fluid returning from the other port of the hydraulic cylinder returns to the prime mover cavity on the inlet side of the prime mover. Unfortunately, this action often creates hydraulic lock within the prime mover because common hydraulic system designs require differing volumetric amounts of fluid on the supply and return sides of a hydraulic system. For example, the amount of fluid required on an inlet side of a hydraulic cylinder is different than the amount of fluid returning from the outlet side of the hydraulic cylinder per unit distance of the travel of the piston or other moving parts within the hydraulic cylinder.

The cause of the different (also known as "unbalanced fluid volume and unbalanced fluid flow") volumetric amounts of fluid is based upon the fact that the cross-sectional area of the full piston bore hole and piston compared with the piston and rod combination within the full piston bore hole on both sides of the hydraulic cylinder are different. Specifically, the effective cross-sectional area on one side of the cylinder is the full bore diameter of the hydraulic piston bore, whereas the effective cross-sectional area on the other side of the cylinder is the cross sectional area of the full piston bore minus the cross sectional area of the piston rod operating inside the full piston bore. If the cross-sectional areas and resulting volumes are not exactly equal, the fluid will cause hydraulic locking of the prime mover due to the fact that the fluid is incompressible. Most pumps acting as prime movers operate in a fashion that provides the ability to move the same amount of fluid into and out of the pumps' cavity. This eventually results in causing rapid pressures changes due to fluid flow imbalances within the hydraulic system thereby leading to hydraulic lock.

The fundamental prime mover arrangement such as a pump and cylinder is unusable for sealed systems where the function required is a controlled and precise unidirectional and/or bi-directional motion within the cylinder. Often systems are employed in which common industrial processes have a variable reservoir capacity included in some location within the hydraulic circuit to ensure performance of this function.

In the case of sealed systems (especially for downhole oil and gas exploration, the automotive and aerospace industries, and in general) it is desirable to provide a solution to this problem by using other than a (relatively large) variable reservoir. The variable reservoir is a term that describes the variability of the volume of fluid in the reservoir at any point in time.

It is preferable to simplify the prime mover arrangement by utilizing a bi-directional power unit that reduces or eliminates the need for piping, pressure regulators, solenoids, and other valves as well as the additional plumbing required for conventional systems. This is possible by providing a reservoir flow balancing compensator technique for primarily sealed systems, which is described in detail below. The nomenclature for one such embodiment is a prime mover system and method utilizing both bidirectional hydraulic power units and fluid reservoir balancing devices that minimizes the size of the variable reservoir.

More specifically, one embodiment of the present invention further describes an HPU (hydraulic power unit) which comprises at least one pump (or other hydraulic fluid moving device often referred to as a "prime mover"), one or more selective control valves to deliver pressurized fluid to the device(s), and one or more second selective control valves to return (mostly unpressurized) fluid from the device(s), a variable reservoir (comprising a compensator tank, a port allowing for operation at ambient pressure, and a pressure measuring device capable of measuring ambient pressure) that allows for unbalanced flow into and away from the mechanical (user) device and allow for thermal expansion or compression of the fluid.

Most specifically, in a more precise embodiment, the present invention is a prime mover apparatus and system for actuating and moving one or more devices in either a single or bi-directional direction using at least one hydraulic power unit(s) comprising one or more pumps, the pumps having at least one inlet and at least one outlet port maintaining pressure to pump fluid in either a clockwise or counterclockwise direction into and out of a pipeline such that the fluid enters and exits the pumps from either a designated clockwise (CW) or counterclockwise (CCW) outlet port thereby creating a clockwise or counterclockwise flow path utilizing valves ensuring balanced fluid flow into and out of the pumps.

The valves of the prime mover apparatus and system allow for fluid flow into and out of at least one reservoir, and wherein the at least one reservoir is vented, sealed, pressure compensated, preloaded and/or expandable. The valve(s) open and close ensuring balanced fluid flow along the flow path with force and direction required to move the moving device(s) in a precise and controlled fashion determined by a user.

The fluid is delivered to at least one port within the moving device(s) and fluid along the flow path from the moving device(s) is blocked, redirected, or continues to flow into one or more additional valves, the additional valves containing components that control fluid flow returning from the moving device(s) back into the pump, thereby completing the flow path and accomplishing an ability to control intermittent or continuous movement of the moving devices.

In the present embodiment, the apparatus and system is an electrical power unit(s) apparatus for actuating and moving one or more devices in either a single or bi-directional direction wherein said hydraulic and/or electric power units are selected from the group consisting of pumps, motors, compressors, engines, turbines and inverters and wherein said pumps can be positive displacement pumps.

It is useful to provide further description of the bi-directional HPU by envisioning the power unit sectioned into four (4) quadrants that coincide with positions within the HPU. In such a case, the first quadrant is designed for delivering power from the HPU to a user device (a device for being moved), resulting in moving the device forward. The second quadrant is positioned and utilized to power the user device back toward the original position. The third and fourth quadrants are used to take power from the device that is being moved, resulting in generating that power back into the energy source (pump, motor, etc.) that is used for power (generating power out through the $3^{rd}$ and $4^{th}$ quadrant). In this case the bidirectional HPU is also acting as a power generator (creating a regeneration or "regen" system). For a unidirectional HPU, only a single quadrant is required if moving a device that, for example, simply rotates and for which the device is moving in only a single (one) direction.

Therefore, it is now clear that at least one embodiment of the present disclosure provides for overcoming flow imbalances associated with conventional prime mover (for example pumps and pump/cylinder) systems by replacing these systems with at least one or more volumetric flow balancing devices and subsequent systems. The current technology for prime movers takes fluid from a reservoir and delivers the fluid with an increased pressure to both a moving device and a pressure regulator so that excess fluid delivered from the prime mover which is not being utilized by the moving device is returned to the reservoir through the pressure regulator. Returning fluid from the moving device returns the fluid to the reservoir not to the prime mover directly. Consequently, convention hydraulic systems for moving devices are very inefficient with regard to the loss of energy due to requiring flow back through conventional flow regulators.

The present disclosure describes a system that is significantly different from the conventional system in that the prime mover directs flow directly to the moving device and then back directly to the prime mover. The flow balancing devices and system ensure that the exact volume of fluid is being sent back into the prime mover as well as that coming out of the prime mover.

In a sealed system, it is desirable and often necessary to ensure all flow of the hydraulic fluid is directed to the device to be moved and that the fluid and fluid flow remains balanced and utilizes a variable reservoir for thermal expansion or slight perturbations. Therefore, much less energy is required to keep the system running.

More specifically, one detailed embodiment of the present invention describes an HPU (hydraulic power unit) which comprises at least one pump (or other hydraulic fluid moving device often referred to as a "prime mover"), one or more selective control valves to deliver pressurized fluid to the device(s), and one or more second selective control valves to return unpressurized fluid from the device(s), a reservoir (comprising a compensator tank, a port allowing for operation at ambient pressure, and a pressure measuring device measuring ambient pressure) that allows for unbalanced flow to and from the mechanical (user) device and thermal expansion or compression. In addition, a fourth optional feature of the compensator tank that enables the system to operate at other than ambient pressure as well as another optional device that is a pressure sensor to monitor and control the fluid pressure being delivered to the mechanical (user) device(s) and optional accumulator to temporarily store and release energy (often in the form of pressurized fluid) to the device(s). The HPU has a fluid leak path (safety valve) that returns the fluid pressure in the hydraulic power unit back to its original starting pressure if and when it is required. It should be recognized that the operating system can be operated in the reverse direction and utilized as an energy source instead of as a prime move which may have an energy storage component. The determination of the utility will be dependent upon the utility requirement of the system described herein.

Most specifically, in a more precise embodiment, the present invention is a prime mover system for actuating and moving one or more devices bi-directionally using at least one hydraulic and/or electrical power unit comprising one or more pumps, the pumps having at least one inlet and at least one outlet port maintaining pressure to pump fluid in either a clockwise or counterclockwise direction into and out of a pipeline such that the fluid exits the pump from either a clockwise (CW) or counterclockwise (CCW) outlet port thereby creating a clockwise or counterclockwise flow path through one or more optional fluid flow filters and through one or more valves wherein the valve(s) open and close ensuring fluid continues along the flow path with force and direction required to move the moving device(s) in a fashion determined by the user; and wherein fluid is delivered to at least one port within the moving device(s) and fluid along the flow path from the moving device(s) is blocked, redirected, or continues to flow in through the one or more additional valves due to components within the valve(s)

thereby returning fluid flow from the moving device(s) thereby completing the flow path and accomplishing the ability to control intermittent or continuous movement within the moving devices.

It is critical that the system allows for fluid flow along the flow path continues flowing into and out of the pumps thereby keeping one or more motor seals and associated ports filled with fluid, thereby reducing or eliminating hydraulic lock and cavitation.

The system also includes a pressure compensator tank that is operationally connected to a pump inlet port of the pump through an optional fluid flow filter and wherein the compensator tank is a portion of a fluid reservoir. The one or more pumps can be a motor.

The fluid reservoir includes at least one compensator tank and a port to ambient pressure and an optional reservoir pressure measuring device that measures ambient pressure and ensures the ability for the system to operate even in the presence of unbalanced flow to and from the moving device(s) and allows for thermal expansion or compression within the system.

In some embodiments the system is a closed system in that the pipeline is completely closed and has no open ports to the atmosphere. In other embodiments, the system is an open system that has at least one port that is opened to the atmosphere.

The system allows for a user to utilize a controller to increase volume, change direction, and/or increase static or dynamic pressure within the fluid along the flow path. Additionally, the fluid within the fluid reservoir can be controlled by a controller.

The system may be powered by hydraulic/electric power units selected from the group consisting of pumps, motors, compressors and inverters.

The system has fluid that reaches an upper bi-directional port of moving device(s) and is delivered to those device(s) and returns from those device(s) into a lower bi-directional port.

The system may also contain devices which equalize the flow in and out of the power unit to accommodate various devices connected to the power unit. The one or more devices are selected from the group consisting of; valves, check valves, pilot operated check valves, shuttle valves, detented shuttle valves, inverted shuttle valves, gates, and solenoids.

The system may also contain at least two sets of pilot operated check valves. The system may also contain one or more valves that are a detented shuttle valve with at least three ports. In addition or separately, the system may also contain one or more valves that are an inverted shuttle valve with at least three ports.

The system may have one or more optional fluid flow filters and one or more optional pressure measuring devices.

The one or more devices are selected from the group consisting of; mechanical devices, electro-mechanical devices and electro-hydraulic devices.

These devices can be one or more of the following; valves, gate valves, ball valves, seat valves, flapper valves, rotary valves, sleeve valves, packers, gears, sub-assemblies, hydraulic cylinders, hydraulic rotary actuators, bladders, accumulators, and reservoirs.

For these devices the valves are selected from the group consisting of: shuttle valves, inverted shuttle valves, inverse shuttle valves, detented shuttle valves, inverted detented shuttle valves, check valves, pilot check valves, solenoid valves, servo valves, ball valves, and gate valves.

In addition, there is a prime mover apparatus for actuating and moving one or more devices in either a single or bi-directional direction along a fluid flow path using at least one hydraulic and/or electrical power unit comprising;

one or more pumps (or motors), the pumps having at least one inlet and at least one outlet port that maintain pressure to pump fluid to flow in either a clockwise or counterclockwise direction into and out of a pipeline such that the fluid exits the pump from either a clockwise (CW) or counterclockwise (CCW) outlet port thereby creating a clockwise or counterclockwise flow path through one or more fluid flow filters and through one or more valves;

wherein the valve(s) open and close ensuring fluid continues along the fluid flow path with force and direction required to move the mechanical user device(s) in a fashion determined by a user;

and wherein fluid is delivered to at least one port within the mechanical user device(s) and fluid along the flow path from the mechanical user device(s) is blocked, redirected, or continues to flow into one or more additional valves, the valves containing components that control fluid flow returning from the mechanical user device(s) thereby completing the flow path and accomplishing the ability to control intermittent or continuous movement of the mechanical user devices.

The present disclosure also includes one or more methods for using a prime mover system to move mechanical user devices comprising, for example;

using one or more pumps (or motors) for providing bi-directional flow of fluid along a flow path having a single inlet port for flow in either the CW or CCW direction so that fluid reaches an upper bi-directional port of a mechanical user device and is delivered to the mechanical user device and returns from the mechanical user device into a lower bi-directional port, wherein the flow path allows fluid to exit the pump from either through a CW or CCW outlet port continuing through a first CW optional fluid flow filter and a CW operating check valve wherein the check valve is ensuring the fluid continues flowing in either the CW or CCW direction and wherein the fluid is delivered through a second optional fluid flow filter to the upper bi-directional port and additionally delivering fluid to a first detented shuttle valve such that the fluid continues through a first detented shuttle valve port to a second detented shuttle valve port wherein the first detented shuttle valve is activated by pressure on the first port moving a shuttle from the first port and sealing "O" rings located near the first detented shuttle valve port to a second detented shuttle valve port sealing the "O" rings located near a second detented shuttle valve port such that the first detented shuttle valve is retained in position by friction forces from a shuttle in contact with the second shuttle valve port thereby sealing "O" rings and such that the fluid continues flowing and is communicated from the first shuttle valve port to a third shuttle valve port that is connected to an optional pressure measuring device and thereby blocking flow from exiting the second shuttle valve port employing a shuttle of the second shuttle valve port by using the sealing "O' rings and wherein;

the fluid is also directed along the flow path to a first port of an inverted shuttle valve wherein the fluid is moving a primary bar-bell shaped shuttle thereby closing an upper portion inverted shuttle valve and opening a lower portion inverted shuttle valve thereby allowing returning flow from a lower bi-directional port through an optional fluid flow filter to the inverted shuttle valve but more specifically causing fluid to flow to and through a first inverted shuttle valve port thereby exiting a second inverted shuttle valve port and completing the flow path within the system wherein;

the fluid flowing within the flow path flow continues flowing and utilizing the pump and specifically continually flows to a pump inlet port and motor seal of the pump, thereby ensuring the pump remains operational during operation of the system.

Here also, the pressure compensator tank is operationally connected to the pump inlet port through an optional fourth fluid flow filter and the compensator is a portion of a reservoir.

The reservoir comprises a compensator tank, a port to ambient pressure and an optional reservoir pressure measuring device for measuring ambient pressure that ensures the ability for a sealed system to operate in the presence of unbalanced flow to and from the mechanical user devices.

The afore-described system allows for thermal expansion or compression within a sealed system.

The mechanical user devices are selected from at least the group consisting of; mechanical devices, electro-mechanical devices and electro-hydraulic devices.

An additional method describes using a prime mover system to move devices comprising; utilizing by controlling fluid flow along a flow path having one or more motors powered using hydraulics and/or electricity together with a check valve arrangement which allows for said system to be run in a reverse direction wherein;

the motors are also utilized as energy generators and wherein the motors drive fluid in a CW direction so that the fluid flow reaches an upper bi-directional port to deliver fluid flow to a balanced hydraulic actuator such as a hydraulic cylinder with piston faces of equal surface areas and wherein the fluid flow returns from one or more balanced hydraulic actuators to a lower bi-directional port;

wherein the fluid flow is next delivered through a second optional fluid flow filter through an upper bi-directional port and additionally the fluid flow is being delivered to a detented shuttle valve and is continuing through at least two ports, A and B of the shuttle valve, the shuttle valve being activated by pressure on port A moving a shuttle of the shuttle valve from port A through sealing "O" rings located near port A to another port B, thereby sealing "O" rings located near port B, wherein the detented shuttle valve is retained in position by friction of the shuttle being in contact with sealing "O" rings of port B such that the fluid flow continues and is now communicated from port A to a third port, C, wherein fluid flows through port C flow through an optional pressure measuring device such that fluid flow is blocked by the shuttle and the sealing "O' rings of port B seal said port such that fluid cannot exit shuttle valve port B.

This method provides two distinct return flow paths, a first return fluid flow path that returns fluid from a balanced hydraulic actuator to said lower bi-directional port through a third optional fluid flow filter to the motors into a CCW outlet port and through a first CCW optional fluid flow filter so that fluid flows through the motors with an exactly equal flow entering a CCW outlet port as is exiting a CW outlet port ensuring the fluid of the fluid flow is provided to reduce or eliminate motor cavitation.

The second return fluid flow path is enabled by a high pressure fluid flow line having fluid flowing into an inverted shuttle valve, specifically to port D of the shuttle valve so that the fluid moves a primary bar-bell shaped shuttle within the shuttle valve thereby closing an upper inverted shuttle valve portion and opening a lower inverted shuttle valve portion. This allows returning fluid flow from a lower bi-directional port through a third optional fluid flow filter for flowing into inverted shuttle valve port E and exiting from port F such that the second flow path is completed as fluid flow continues to the motors and pressure from the fluid seals motor seal ports, thereby keeping fluid pressure across the motor seal ports.

The pressure from the fluid is static pressure providing pressure equalization during operation of the inverted shuttle valve such that internal motor shaft seals will not fail.

The motor shaft seals are seals that exist around a shaft of a motor to ensure that when the shaft rotates, excessive heat due to mechanical friction is not produced by using the fluid as a heat transfer medium through the shaft seals.

The system or methods described include valves selected from the group consisting of shuttle valves, inverted shuttle valves, inverse shuttle valves, detented shuttle valves, inverted detented shuttle valves, inverse detented shuttle valves, check valves and pilot check valves.

Also, these valves are provided in parallel, in series, or in any combination of parallel and series throughout the system as required so that the system is operational and so that the fluid can travel in either a unidirectional and/or bi-directional flow path through the system and so that the fluid powers devices that can operate in a singular or bi-directional fashion.

In further embodiments it is also possible to provide compressed fluid energy storage systems using what has been described. Such systems may be implemented using a hydraulic drive system comprised of hydraulic components including components such as hydraulic pumps used to drive working pistons. Therefore, there is also a need for systems and methods to obtain a high efficiency output of a compressed fluid energy storage system, or other systems used to compress and/or expand gas, including controls and operating modes that leverage bi-directional movement of devices during operation of such systems.

The apparatus and system are provided wherein the hydraulic power unit (HPU) moves a prime mover by using energy to move fluid in a flow path, the HPU extracts energy from a flow path to an external energy sink and the HPU is a flow measuring device.

In a further set of embodiments, a prime mover apparatus and system for actuating and moving one or more moving devices in either a single or bi-directional direction that utilizes at least one hydraulic power unit(s) (HPU) is described comprising;

one or more multiport pumps, the pumps having at least one inlet port, one outlet port, and one reservoir port that act to balance fluid flow and allow fluid flow in either a clockwise or counterclockwise direction into and out of a pipeline that has access to at least one reservoir such that the fluid flow enters and exits the pumps from either a designated clockwise (CW) or counterclockwise (CCW) inlet/outlet port such that a clockwise or counterclockwise flow path is created with one or more multiport pumps and ensures balanced fluid flow into and out of the apparatus and system.

Here, the prime mover apparatus and system have one or more pumps are selected from the group consisting of; swashplate pumps, reciprocating pumps, scroll pumps, piston pumps, positive displacement pumps, diaphragm pumps, injection pumps, centrifugal pumps, gear pumps, and metering pumps.

The one or more pumps are at least one swashplate pump that includes a multi-port valve plate such that fluid flow into and out of the swashplate pump is either unidirectional or bidirectional, wherein the multi-port valve plate includes at least three ports.

The swashplate pump together with the at least three-port valve plate ensures balanced fluid flow exists and is maintained within the pump in that the fluid flow volume remains constant throughout operation of the swashplate pump and within the pipeline as the pump is utilized for operation of the apparatus and system.

The swashplate pump includes a multi-port valve plate that provides at least three ports, wherein at least one port is designated for counterclockwise flow, at least one port is designated for clockwise flow and at least one port is designated as a reservoir port, wherein the reservoir port allows for fluid flow balancing in that fluid is either replaced or added as required to keep the fluid balanced.

In at least one embodiment, the swashplate pump with a three-port valve plate integrates all features that require use of an inverse shuttle valve within the apparatus and system, and wherein a four-port or more valve plate integrates all needed features that require use of both a detented shuttle valve and said inverse shuttle valve, thereby reducing cost, complexity, and risk of failure caused by inoperative valves.

The at least three-port valve plate includes an additional monitor port, wherein the monitor port provides a location for sensors and/or hydraulic actuators.

The at least one swashplate pump and/or additional pumps move in a clockwise direction as they deliver fluid to a clockwise port and withdraw fluid from a counterclockwise port.

The pumps may also move in counterclockwise direction they deliver fluid to a counterclockwise port and withdraw fluid from a clockwise port.

In some cases, the pumps and/or three-port valve plate(s) with the swashplate pump are immersed in at least one reservoir.

The pumps and/or swashplate pump allows for fluid flow into and out of at least one reservoir.

The least one reservoir is vented, sealed, pressure compensated, preloaded and/or expandable.

Here the pumps have at least three ports that open and close ensuring balanced fluid flow is maintained along the flow path with force and direction required to move, control, and/or maintain position of one or more moving device(s) in a precise and controlled fashion as determined by a user.

One of at least three ports is utilized as a reservoir port and a sensor port so that a sensor can be inserted into the port(s) to measure pressure, temperature, and additional fluid parameters within the pumps as well as within the apparatus and system.

In yet another embodiment, the fluid is delivered to at least one port within the moving device(s) and fluid along the flow path from moving device(s) is blocked, redirected, or continues to flow into one or more pumps said pumps containing components that control fluid flow returning from moving device(s) back into the pumps, thereby completing the flow path and accomplishing an ability to control intermittent or continuous movement of the moving devices.

Here, the apparatus and system can be an electrical power unit(s) apparatus for actuating and moving one or more devices in either a single or bi-directional direction wherein hydraulic and/or electric power units are selected from the group consisting of pumps, motors, compressors, engines, turbines and inverters.

In at least one embodiment, the fluid flow along the flow path continues flowing into and out of the pumps thereby keeping one or more motor seals and associated ports filled with fluid that results in the reduction and/or elimination of hydraulic lock and cavitation.

The system may also include a pressure compensator tank that is operationally connected to a pump inlet port of the pump through an optional fluid flow filter and wherein the compensator tank is a portion of a variable fluid reservoir.

In all embodiments, the one or more pumps function as a motor.

The fluid reservoir includes at least one compensator tank and a port to ambient pressure and an optional reservoir pressure measuring device that measures ambient pressure and ensures the ability for the system to operate even in the presence of unbalanced flow to and from the moving device(s) and allows for thermal expansion or compression within the system.

In at least one embodiment system is a closed system in that the pipeline is completely closed and has no open ports to the atmosphere.

The system can also be an open system in that the pipeline has at least one port that is opened to the atmosphere.

The user is able to utilize a controller to increase volume, change direction, and/or increase static or dynamic pressure within the fluid along the fluid flow path.

The fluid within the fluid reservoir may be controlled by a controller.

In yet another embodiment, the fluid reaches an upper bi-directional port of said moving device(s) and is delivered to the moving device(s) and returns from the moving device(s) into a lower bi-directional port.

The system contains at least one valve the valve can be a check valve and wherein the check valve has two ports.

In one or more embodiments, the system contains at least one set of pilot operated check valves the pilot operated check valves have at least three ports.

The system may also contain at least two sets of pilot operated check valve wherein the system contains one or more valves that is a detented shuttle valve with at least three ports.

The system may also contain one or more valves that is an inverted shuttle valve with at least three ports.

The pipeline may have at least one fluid flow filter.

The pipeline may also have at least one pressure measuring device.

In at least one embodiment, the one or more moving devices are selected from the group consisting of; mechanical devices, electro-mechanical devices, electro-hydraulic devices and actuator devices.

In this case, the one or more moving devices are valves, gate valves, ball valves, seat valves, flapper valves, rotary valves, sleeve valves, packers, gears, sub-assemblies, hydraulic cylinders, hydraulic rotary actuators, bladders, accumulators, and reservoirs.

Here the valves are selected from the group consisting of: shuttle valves, inverted shuttle valves, inverse shuttle valves, detented shuttle valves, inverted detented shuttle valves, check valves, pilot check valves, solenoid valves, servo valves, ball valves, and gate valves.

The valves are provided in parallel, in series, or in any combination of parallel and series throughout the system so that the system is operational in that fluid can travel in either a unidirectional and/or bi-directional flow path through the system and so that fluid powers devices that operate in either a singular or bi-directional manner.

In most if not all embodiments the hydraulic power unit (HPU) moves a prime mover by using energy to move fluid in a flow path and maintains pressure required to lock a position of the moving devices and maintains pressure utilizing one or more check valves.

In at least one embodiment, the hydraulic power unit (HPU) does not maintain pressure when the apparatus and system is intentionally or unintentionally not receiving energy so that the pumps are no longer functioning in a forward direction but are able to function in a reverse direction such that pressure that acts on the moving devices is released and reduced to greater than or equal to zero such that the moving devices can reach and reside in any desired static position.

In all embodiments, the hydraulic power unit (HPU) may extract energy from a flow path and deposit the energy into an external energy sink.

The prime mover apparatus may function as a flow measuring device.

In some embodiments the mechanical devices themselves are more commonly referred to as hydraulic devices and/or systems that include one or more hydraulic actuators and hydraulic controllers. Alternatively, or in combination, the devices themselves are electrical or electro-hydraulic devices and/or systems that include one or more electrical actuators and controllers. Operation of some of the systems included as a portion of the present invention and disclosure are detailed in the following embodiments.

DETAILED DESCRIPTION

In some embodiments of the present disclosure, an actuator, such as a valve can include one or more pump systems, such as for example, one or more hydraulic pumps that can be used to move one or more fluids within the actuators. U.S. Provisional App. No. 61/216,942, to Ingersoll, et al., filed May 22, 2009, entitled "Compressor and/or Expander Device," and U.S. patent application Ser. No. 12/785,086, Ser. No. 12/785,093 and Ser. No. 12/785,100, each filed May 21, 2010 and entitled "Compressor and/or Expander Device" (collectively referred to herein as the "the Compressor and/or Expander Device applications"), the disclosures of which are hereby incorporated herein by reference, in their entireties, describe various energy compression and/or expansion systems in which the systems and methods described herein can be employed.

The hydraulic actuator can be coupleable to a hydraulic pump, which can have efficient operating ranges that can vary as a function of, for example, flow rate and pressure, among other parameters. Systems and methods of operating the hydraulic pumps/motors to allow them to function at an optimal efficiency throughout the stroke or cycle of the gas compression and/or expansion system are described in U.S. patent application Ser. No. 12/977,724 to Ingersoll, et al., filed Dec. 23, 2010, entitled "Systems and Methods for Optimizing Efficiency of a Hydraulically Actuated System," ("the '724 application") the disclosure of which is incorporated herein by reference in its entirety as well as U.S. Pat. No. 8,522,538 entitled "Systems and methods for compressing and/or expanding a gas utilizing a bi-directional piston and hydraulic actuator".

Most specifically, the present disclosure includes the embodiments as shown in FIGS. 1-7 and described below. For all figures, the keys provided indicate high pressure flow and static lines are bolded while the low pressure flow and static lines are presented as unbolded. Arrows are used to indicate clockwise and/or counterclockwise direction(s) for the flow. This allows for unidirectional or bidirectional flow to occur as presented. Inactive lines are presented as dashed for flow or dotted for static lines. The filled dots represent areas of high pressure and static flow, the unfilled dots represent areas of low pressure and static flow, both within the piping system.

Figure 1A:
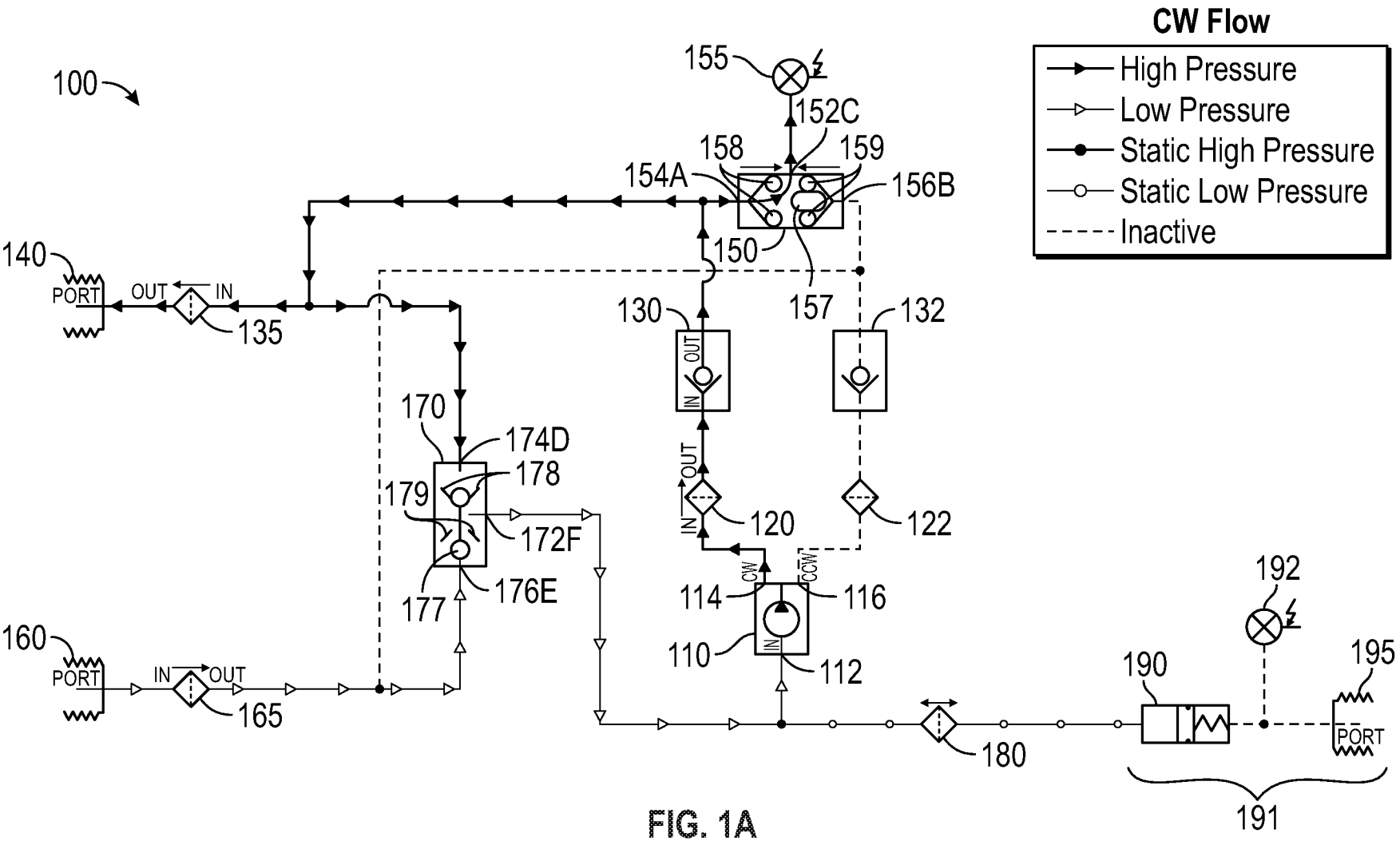
FIGS. 1A and 1E are schematic illustrations of a CW/CCW (clockwise/counterclockwise) fluid-based pumping only power unit with shuttle valves, illustrating a valving system according to one or more embodiments.

FIG. 1A is a schematic that provides an initial embodiment of the present disclosure illustrating the HPU system I (100) utilizing one or more pressure pumps that operate in CW (clockwise) or CCW (counter clockwise) rotation, to accomplish supplying high pressure fluid to a mechanical (user) device and returning low pressure fluid from the device back to at least one pump. This system is referred to as a hydraulic power unit (HPU) that powers the prime mover. The power unit (PU) could also be driven by electrical power derived from various sources including wind and solar energy.

Here the HPU system (100) utilizes the pump (110), having a single inlet port (112), in the CW direction so that the fluid reaches the upper bi-directional port (140) and is delivered to the mechanical (user) device and returns from the mechanical (user) device into lower bi-directional port (160). Although the system described is directed to moving mechanical (user) devices, it is to be understood that the prime mover concept taught herein is also applicable to moving devices that are not mechanical.

Figure 1D:
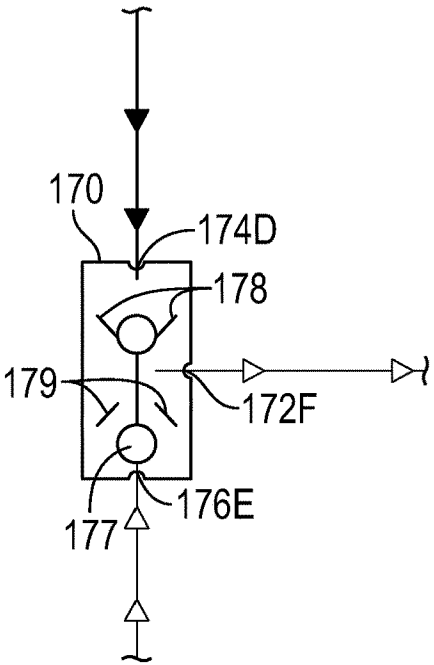
FIGS. 1B-1D provide detailed enlarged portions of the valve components of FIGS. 1A and 1E.
Figure 1C:
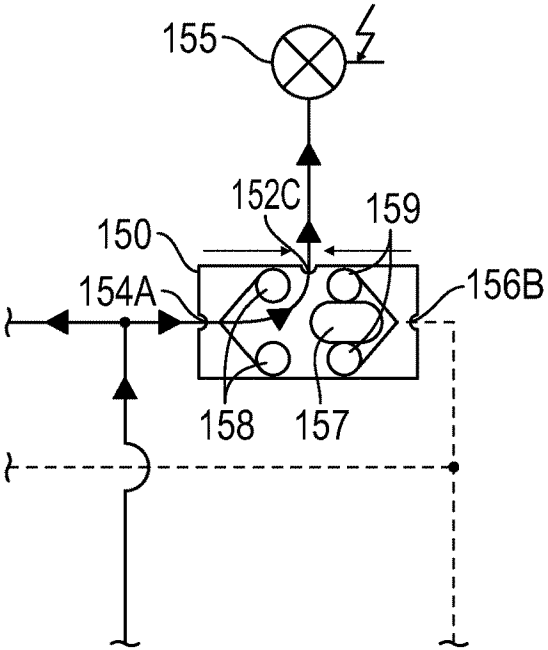
Figure 1B:
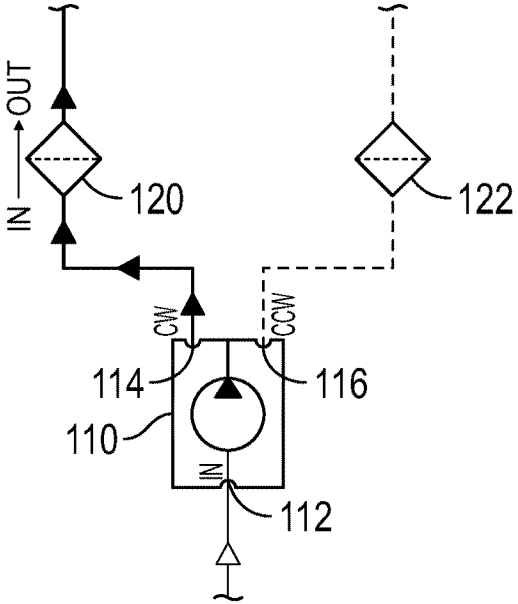

The fluids' path in this case starts with one or more pump or pumps (110) such that the fluid exits the pump (110) from the CW outlet port (114), goes through the first CW optional fluid flow filter (120), as further detailed in FIG. 1B and CW check valve (130). The check valve is utilized to ensure that the fluid continues to flow in the proper direction. The fluid is delivered through the second optional fluid flow filter (135) to the upper bi-directional port (140). In addition, fluid is also delivered to a detented shuttle valve (150), for which an expanded (exploded) view is provided in FIG. 1C, and continues through the detented shuttle valve port A, herein port A (154) to detented shuttle valve port C, herein port C (152). The detented shuttle valve (150) is activated by the pressure on port A (154) moving the shuttle (157) from port A sealing "O" rings (158), located near port A (154), to port B sealing "O" rings (159), located near detented shuttle valve port B, herein port B (156). The detented shuttle valve (150) is retained in position by the friction of the shuttle (157) against the port B sealing "O" rings (159). Flow continues and is now communicated from port A (154) to port C (152) that is connected to an optional pressure measuring device (155).

In addition, flow is blocked by the shuttle (157) and port B sealing "O' rings (159) from exiting port B (156).

Also additionally, in FIG. 1A and provided in further detail in the expanded view shown in FIG. 1D the flow is directed to an inverted shuttle valve (170) specifically to inverted shuttle valve port D, herein port D (174) which moves the primary bar-bell shaped shuttle (177) thereby closing the upper portion inverted shuttle valve (178) and opening the lower portion inverted shuttle valve (179). This allows returning flow from lower bi-directional port (160) through optional fluid flow filter (165) to the inverted shuttle valve (170) but specifically to and through inverted shuttle valve port E, herein port E (176) thereby exiting inverted shuttle valve port F, herein port F (172). Completing the flow path within this closed system; the fluid flow continues to be flowing and utilizing pump (110) and specifically to pump inlet port (112). Note that the optional pressure compensator tank (190) is operationally connected to pump inlet port (112) through the optional fourth fluid flow filter (180). The compensator is a portion of the reservoir (191) (comprising the compensator tank (190), a port to ambient pressure (195) and an optional reservoir pressure measuring device (192) for measuring ambient pressure) that ensures the ability for a sealed (closed) system to operate even in the presence of unbalanced flow to and from the mechanical (user) device. In addition, it allows for thermal expansion or compression within the sealed (closed) system. This completes the flow path within this closed system.

Figure 1E:
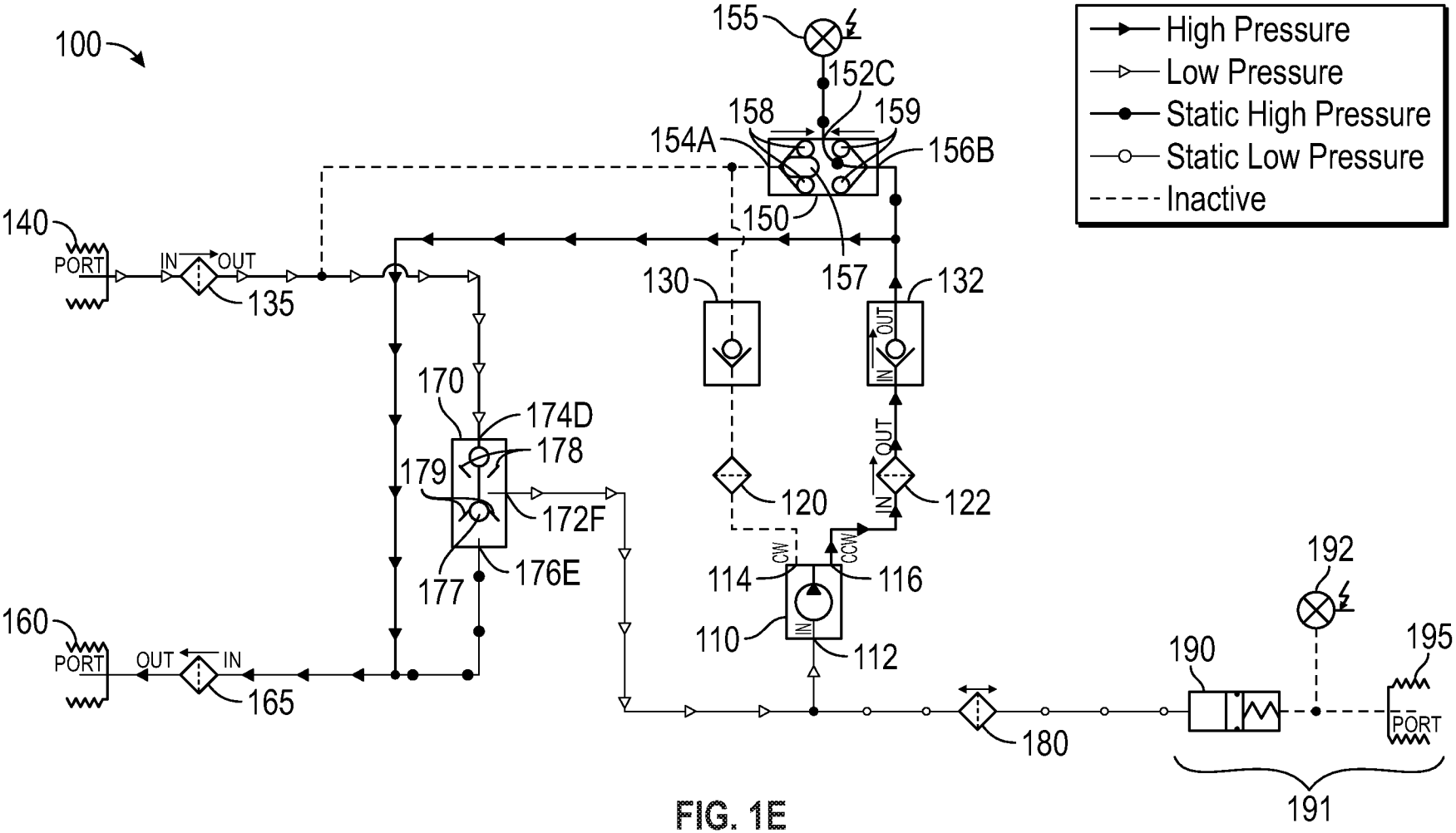

FIG. 1E provides an identical schema as shown in FIG. 1A, with the exception, however, that in this case the pump or pumps (110) are rotated in a CCW fashion. The resulting fluid flow path now provides one or more hydraulically operable mechanical (user) devices (not shown) for the pressurized fluid to exit from the lower bi-directional port (160) and return as unpressurized fluid from the upper bi-directional port (140). Specifically fluid is being delivered to the lower bi-directional port (160) and taken from the upper bi-directional port (140) that controls the mechanical (user) devices (typically a rotary actuator or piston) as follows; the fluids' path in this case starts with pump or pumps (110) where the fluid exits the pump (110) from the CCW outlet port (116), goes through the first CCW optional fluid flow filter (122), as further detailed in FIG. 1B and CCW check valve (132). Fluid flows to and through the detented shuttle valve (150), moving the shuttle (157) from port B sealing "O" rings (159) to port A sealing "O" rings (158) connecting port B (156) to port C (152) and blocking port A (154).

Also additionally, the flow is directed to and through an inverted shuttle valve (170) specifically to port D (176) which moves the primary bar-bell shaped shuttle (177) thereby closing the lower portion inverted shuttle valve (179) and opening the upper portion inverted shuttle valve (178). This allows returning flow from the upper bi-directional port (140) through the second optional fluid flow filter (135) to the inverted shuttle valve (170) but specifically to and through port D (174) thereby exiting port F (172). Completing the flow path within this closed system; the flow continues to pump (110) and specifically sends the fluid to the pump inlet port (112).

Figure 2A:
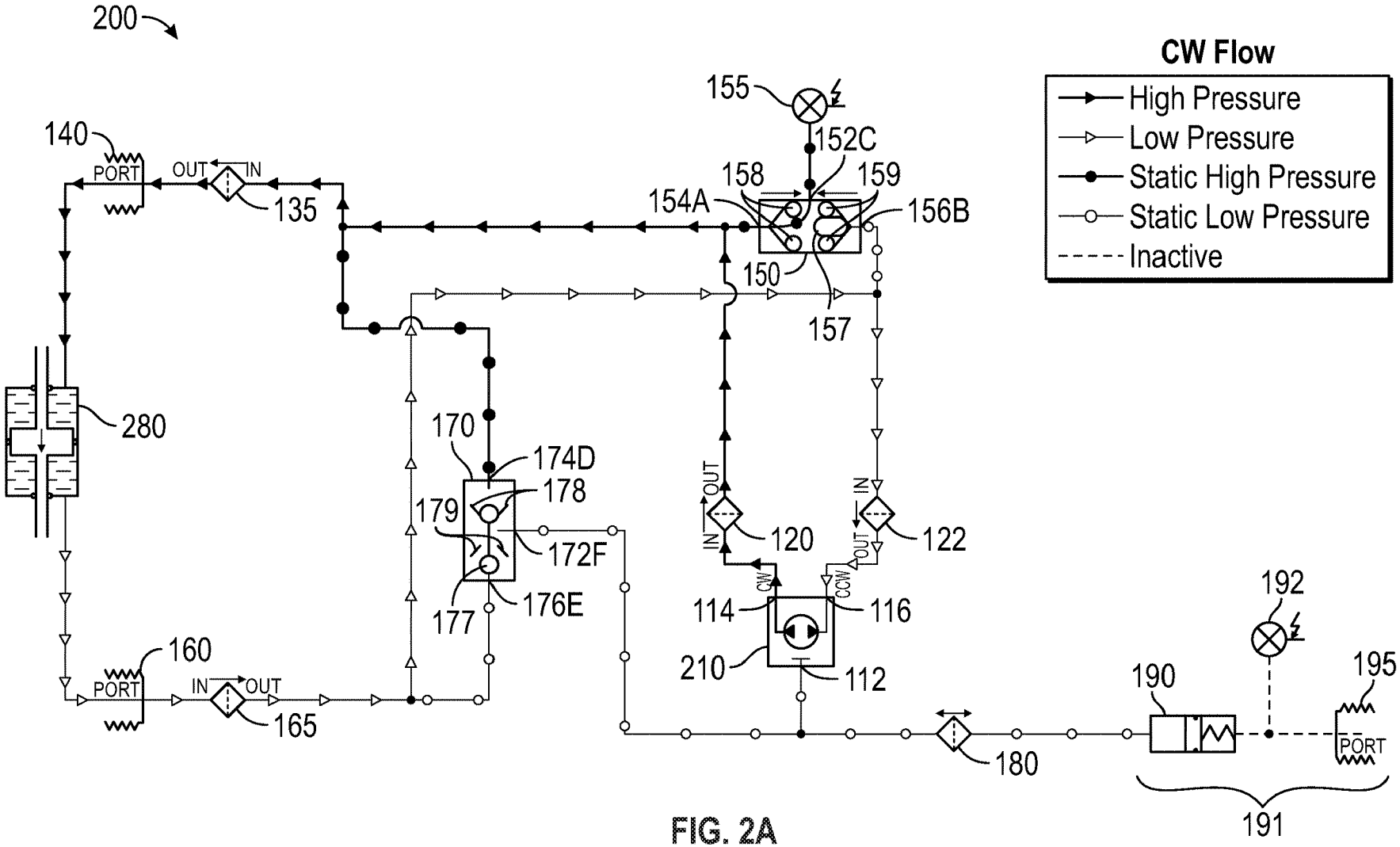
FIGS. 2A and 2C are schematic illustrations of a CW/CCW fluid-based pumping and generation power unit with shuttle valves connected to a balanced flow device, illustrating a valving system according to one or more embodiments.
Figure 2B:
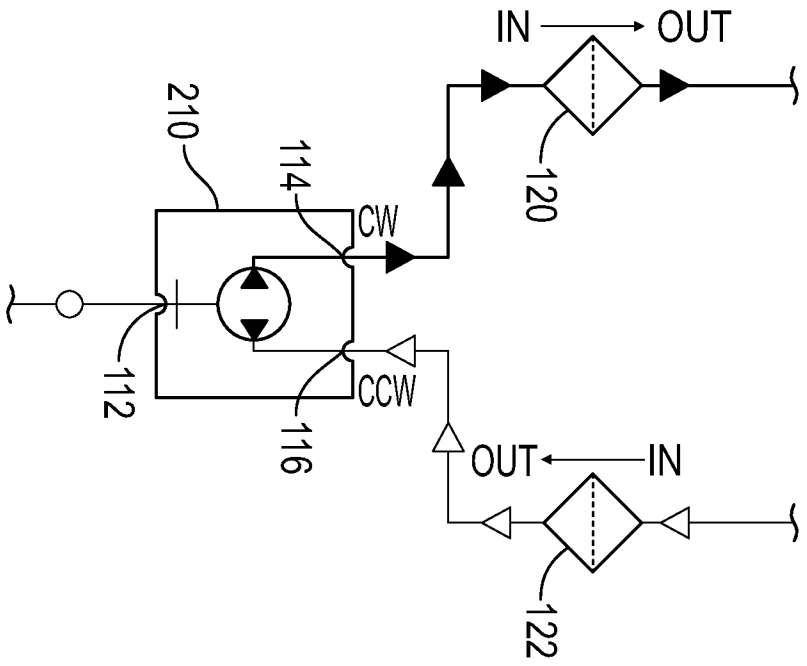
FIG. 2B provides detailed enlarged portions of the valve components of FIGS. 2A and 2C.

FIG. 2A is a schematic that details another embodiment of the present disclosure utilizing a motor (210), where in this embodiment the prime mover is also hydraulic powered but could also be electrically powered. Using the motor or motors (210) instead of a pump with the check valve arrangement such as in FIGS. 1A and 1E allows for the system to be run in the "reverse" direction and thereby the motors could also be utilized as energy generators. Again the use of the system will depend on the required need(s)—in many cases utilizing the system to generate energy will be required. Here, this embodiment the HPU system II (200) utilizes the motor in the CW direction so that the fluid reaches the upper bi-directional port (140) to deliver fluid to a balanced hydraulic actuator (280) such as a hydraulic cylinder with piston faces of equal surface areas. The fluid returns from the balanced hydraulic actuator (280) to the lower bi-directional port (160). The fluid path in this case, beginning at the motor or motors (210), provides for fluid exiting the motor from the CW outlet port (114) and flowing through the first CW optional fluid flow filter (120), as shown in expanded detail in FIG. 2B. The fluid is next delivered through the second optional fluid flow filter (135) to the upper bi-directional port (140). In addition the fluid is delivered to a detented shuttle valve (150) and continues through port A (154) to port C (152). The detented shuttle valve is activated by the pressure on port A (154) moving the shuttle (157) from the port A sealing "O" rings (158), located near port A (154), to the port B sealing "O" rings (159) located near port B (156). The detented shuttle valve is retained in position by the friction of the shuttle (157) against the port B sealing "O" rings (159). Flow continues and is now communicated from port A (154) to port C (152) which is also connected to optional pressure measuring device (155).

In addition, flow is blocked by the shuttle (157) and the port B sealing "O' rings (159) from exiting shuttle valve port B (156), a provided in detail in FIG. 1C.

In this instance, there are two distinct return flow paths. The first return fluid flow path returns from the balanced hydraulic actuator (280) to the lower bi-directional port (160) through the third optional fluid flow filter (165) to the motor (210), into the CCW outlet port (116) and through the first CCW optional fluid flow filter (122). It is critical here that the flow through the motor (210) must have an exactly equal flow entering the CCW outlet port (116) as is exiting the CW outlet port (114). Without this condition, the motor will begin to cavitate and operate improperly or abnormally (as opposed to operating properly or normally).

The second return flow path is enabled by the high pressure flow line connected to the inverted shuttle valve (170) specifically to port D (174) which moves the primary bar-bell shaped shuttle (177) thereby closing the upper portion inverted shuttle valve (178) and opening the lower portion inverted shuttle valve (179). This allows returning flow from the lower bi-directional port (160) through the third optional fluid flow filter (165) to the inverted shuttle valve (170) but specifically to and through port E (176) thereby exiting port F (172). Completing the flow path, the flow continues to the motor (210) and specifically to the motor seal port (112), which is a requirement for the proper operation of the motor (210). What is achieved by this second return flow path is that the fluid pressure across the seal is kept within the manufacture's specifications. Without this static pressure equalization caused by this operation of the inverted shuttle valve (170), the internal motor shaft seals (not numbered) will fail. Motor shaft seals are seals that exist around the shaft of a motor to ensure that when the shaft rotates it does not build excessive heat and allows for heat (due to mechanical friction) to be transferred through the seals to a heat transfer fluid.

Note that the optional pressure compensator tank (190) is connected to the inverted shuttle valve (170) and port F (172). The pressure compensator tank (190) is a portion of the reservoir (191) (comprising the compensator tank (190), a port to ambient pressure (195) and an optional reservoir pressure measuring device (192) measuring ambient pressure) that ensures the ability for a sealed (closed) system to operate even in the presence of unbalanced flow to and from the balanced hydraulic actuator (280). In addition, it allows for thermal expansion or compression within the sealed (closed) system. This completes the flow path within this closed system.

Figure 2C:
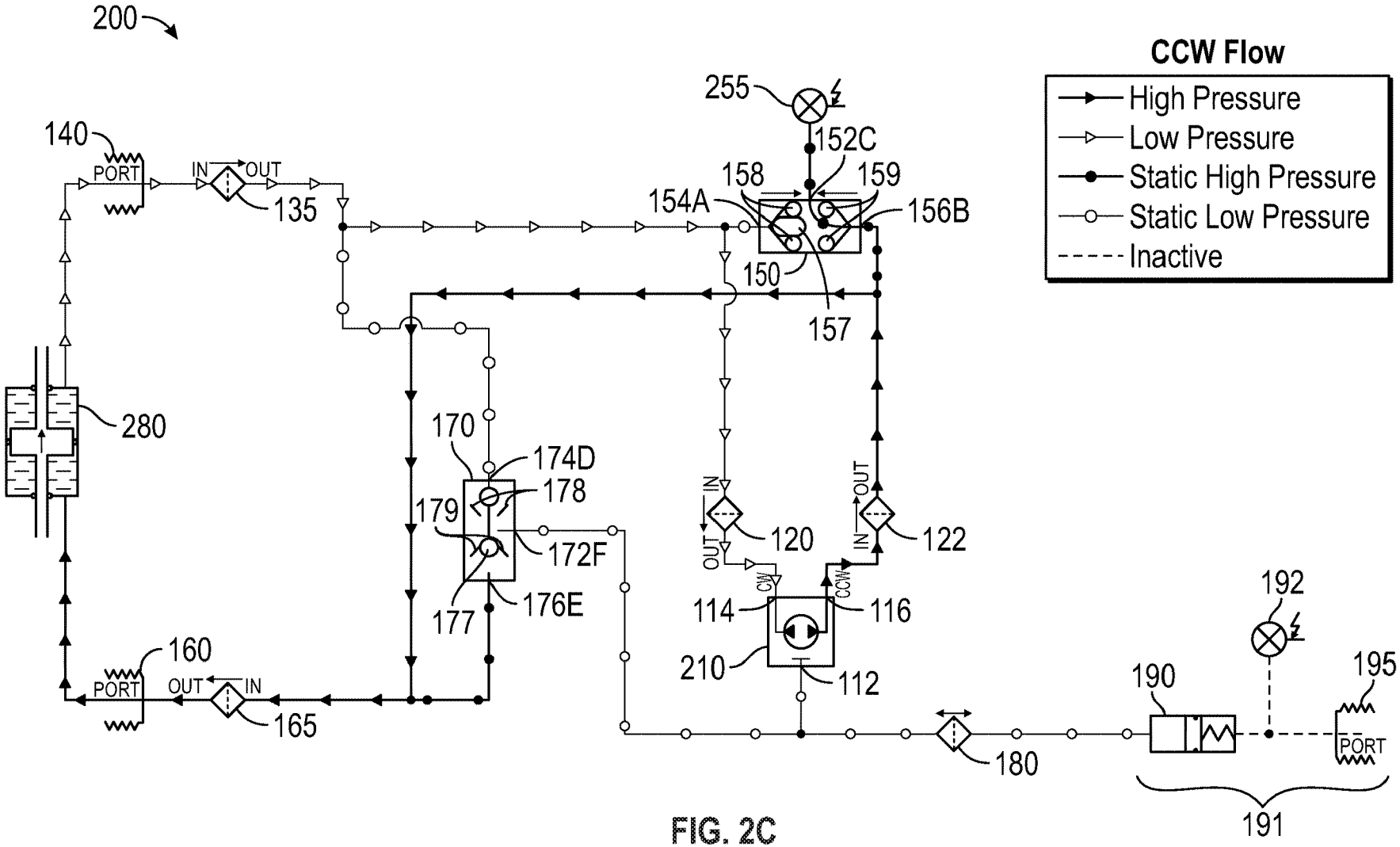

FIG. 2C provides the identical schema as shown for FIG. 2A, however in this case the motor or motors (210) are rotated in a CCW flow fashion. The resulting fluid flow path now provides for a balanced hydraulic actuator (280) for the pressurized fluid to exit from lower bi-directional port (160) and return as unpressurized fluid from upper bi-directional port (140). Specifically this is accomplished by fluid flowing to and through the detented shuttle valve (150) moving through the shuttle (157) from port B sealing "O" rings (159) to the port A sealing "O" rings (158) connecting port B (156) to port C (152) and blocking port A (154).

Also additionally, the flow is directed to and through an inverted shuttle valve (170) specifically to port E (176) which moves the primary bar-bell shaped shuttle (177) thereby closing the upper portion inverted shuttle valve (178) and opening the lower portion inverted shuttle valve (179). This allows returning flow from the upper bi-directional port (140) through optional second fluid flow filter (135) to the inverted shuttle valve (170) but specifically to and through port D (174) thereby exiting port F (172). Completing the flow path within this closed system; the flow continues to the motor (210) and specifically motor seal port (112).

Figure 3A:
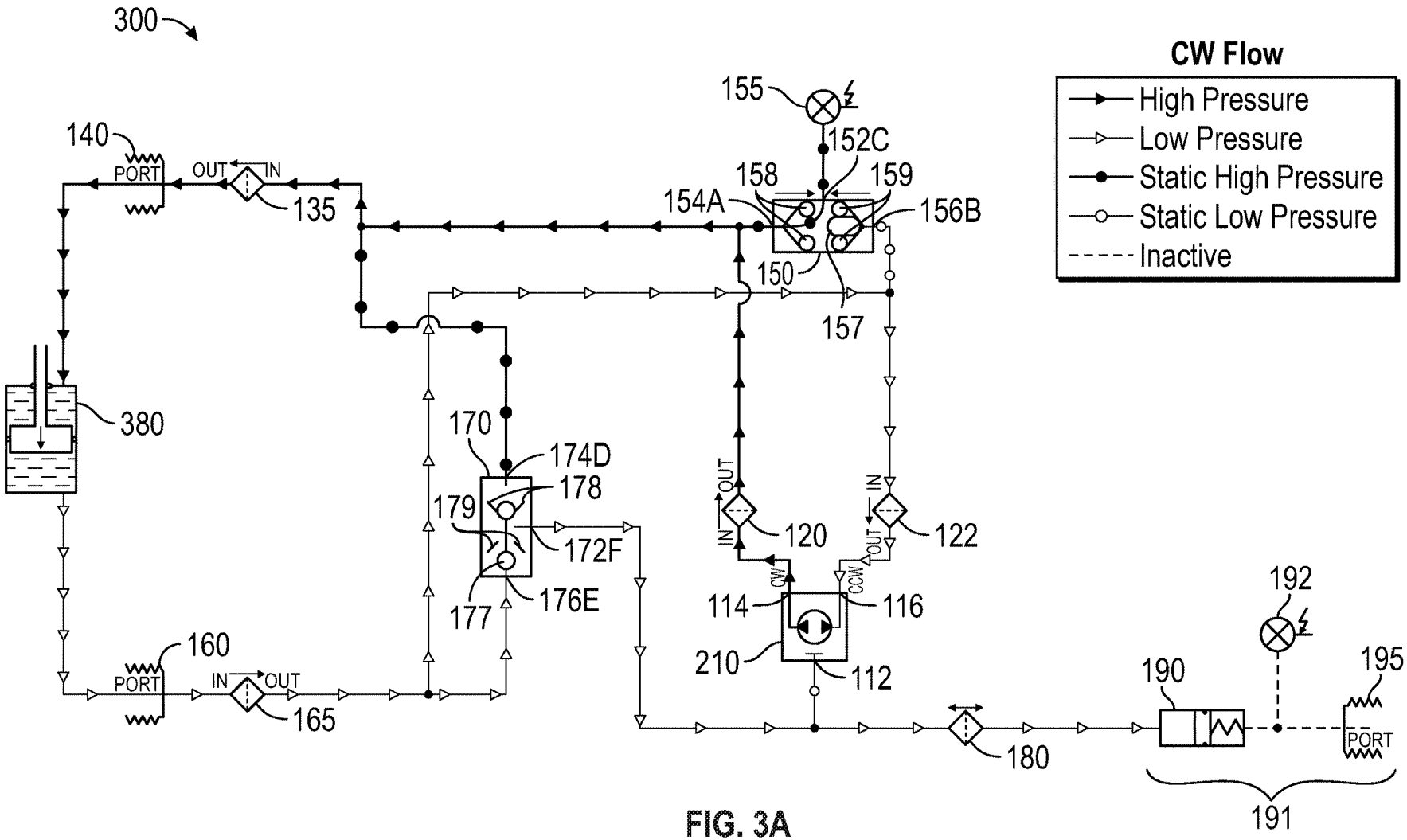
FIGS. 3A-3B are schematic illustrations of a CW/CCW fluid-based pumping and generation power unit with shuttle valves connected to an unbalanced flow device, illustrating a valving system according to one or more embodiments.

FIG. 3A provides the same schema as shown in FIG. 2A, utilizing a motor (210) where in this embodiment the prime mover is also primarily hydraulic. Here, however, the HPU system III (300) utilizes the motor (210) in the CW direction so that the fluid reaches the upper bi-directional port (140) to deliver fluid to an unbalanced hydraulic actuator (380) (the mechanical user device) such as a hydraulic cylinder with piston faces of unequal surface areas. The fluid returning also returns by two distinct flow paths from the unbalanced hydraulic actuator (380) to the lower bi-directional port (160).

In this instance, there are also two distinct return flow paths. The first return fluid flow is identical to that of FIG. 2A, however from an unbalanced hydraulic actuator (380) to the lower bi-directional port (160) through the third optional fluid flow filter (165) to the motor (210) and specifically the CCW outlet port (116) through first CCW optional fluid flow filter (122). It is critical here that the flow through the motor (210) must have an exactly equal flow entering the CCW outlet port (116) as is exiting the CW outlet port (114). To accomplish this condition, any imbalance of flow is compensated by the second return flow path. In the second return flow path, which can be described identically to that of the description for FIG. 2A, an imbalance could be either an excess of fluid returning from the unbalanced hydraulic actuator (380) or insufficient fluid from the unbalanced hydraulic actuator (380). If there is an excess of fluid, the excess flows through inverted shuttle valve (170) into the pressure compensation tank (190). If the flow is insufficient, then flow will be directed from the compensation tank (190) to the inverted shuttle valve (170) back toward the motor (210

Note that the optional pressure compensator tank (190) is connected to the inverted shuttle valve (170) and port F (172) to ensure that the volumetric flow of fluid into and out of the hydraulic motor (210) remains the same as described above. This completes the flow path within this closed system The HPU system does not have to be a "closed" system. The pressure compensation tank (190) could be a reservoir that has the required size and location to operate as an energy storage mechanism where fluid from an external source could be pumped into the reservoir effectively storing energy within the reservoir. The reservoir would then be "drained" as required through the HPU to generate power.

Figure 3B:
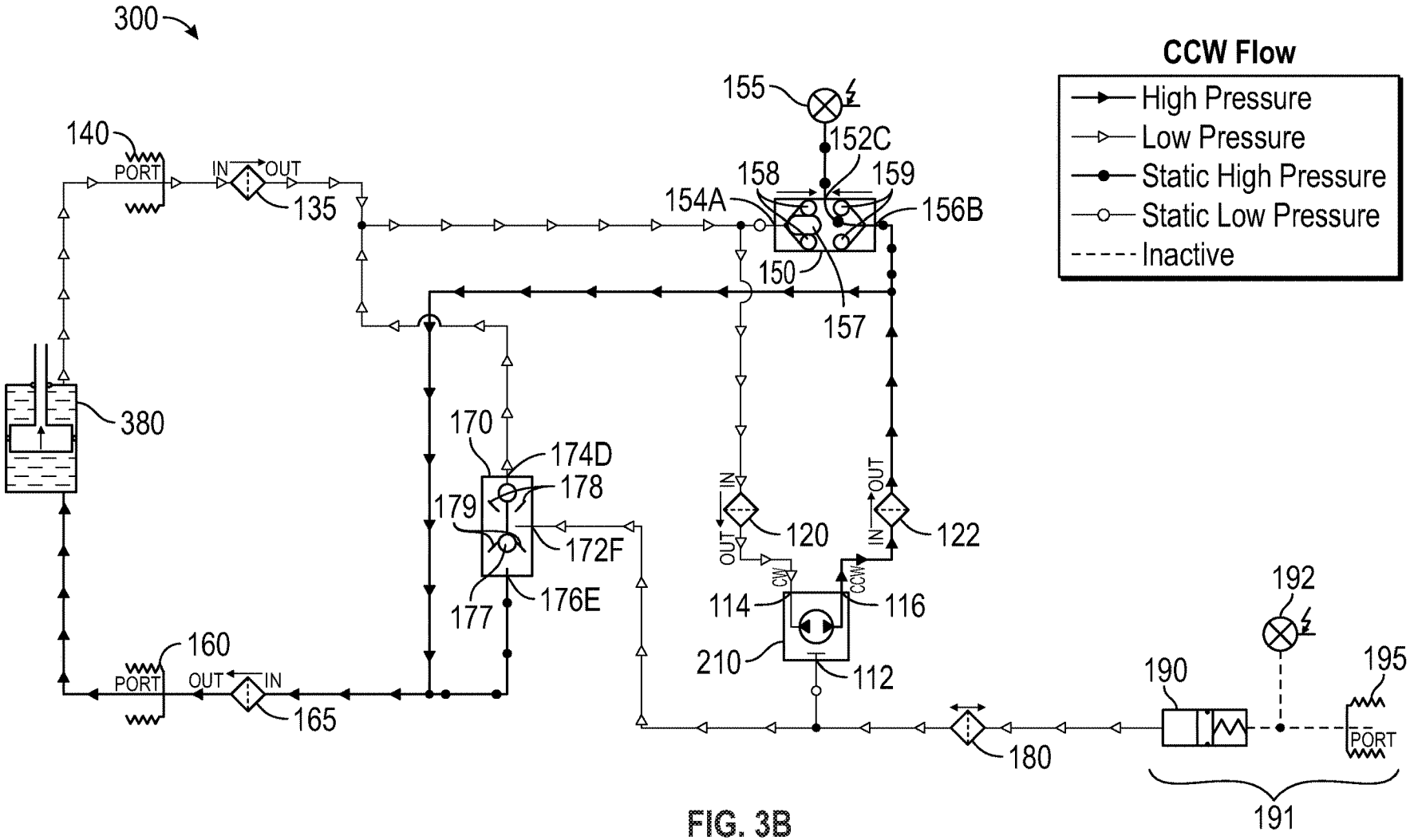

FIG. 3B provides the identical schema as for FIG. 3A, however in this case the motor or motors (210) are rotated in a CCW flow fashion. The resulting fluid flow path now provides for an unbalanced hydraulic actuator (380) for the pressurized fluid to exit from the lower bi-directional port (160) and return as unpressurized fluid from upper bi-directional port (140). Specifically, this is accomplished by fluid flowing to and through the detented shuttle valve (150) moving the shuttle (157) from port B sealing "O" rings (159) to port A sealing "O" rings (158) therefore connecting port B (156) to port C (152) and blocking port A (154). A make-up fluid flow is required to keep the fluid system equilibrated. This flow is provided as a low pressure line from the fluid reservoir (191), because out-flow from the unbalanced hydraulic actuator (380) is less than the in-flow to the unbalanced hydraulic actuator (380) when actuated in this direction.

Also additionally, the make-up fluid flow is directed from the fluid reservoir (191) to and through the fourth optional fluid filter (180)) thereby entering the inverted shuttle valve (170) specifically through port F (172) and exiting specifically to and through port D (174). Completing the flow path within this closed system; the flow continues to the motor (210) specifically entering through the CW inlet port (114).

Figure 4:
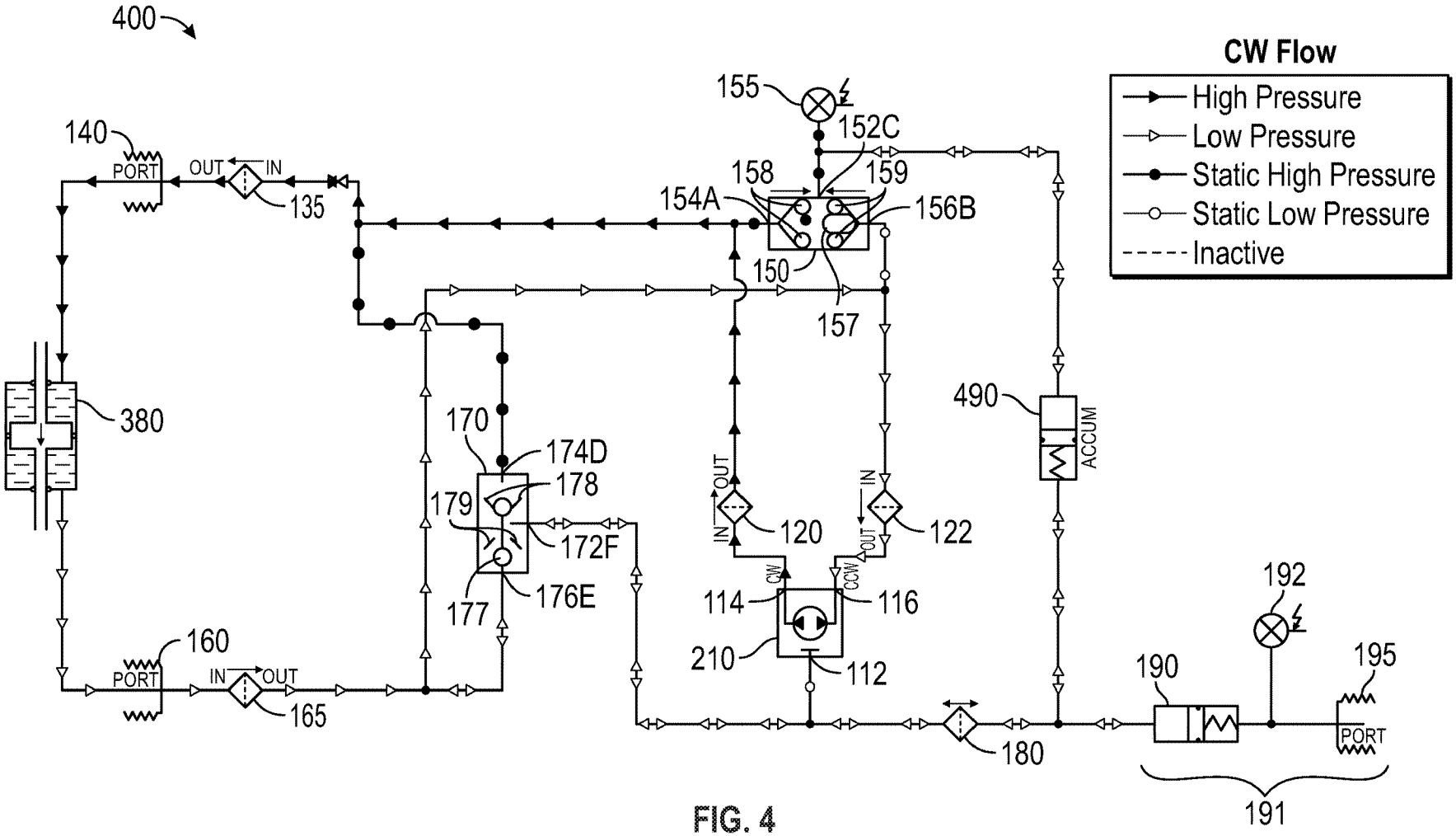
FIG. 4 is a schematic illustration of a CW/CCW fluid-based power unit, illustrating an accumulator included in a valving system according to one or more embodiments.

FIG. 4 is a schematic of HPU system IV (400) which is identical to FIGS. 2A and 2C and FIGS. 3A and 3B with the addition of an accumulator (490) and reversible pressurization of the previously static line from the reservoir (191) to the junction adjacent to the second optional fluid filter (165). The primary purpose of the accumulator (490) is to store and release hydraulic energy by storing excess energy created by the motor or motors (210) and releasing the stored energy on demand. This results in a system that improves the longevity of the motor by reducing mechanical wear on the components due to lessening of the transient pressure fluctuations due to larger fluctuations between high and low flow rates and pressures. The accumulator (490) can store energy that allows intermittent operation of the motor or motors (210) as required. In addition the accumulator (490) can store energy available from the hydraulic actuator (balanced (280) or unbalanced (380)) to be utilized by the motor or motors (210) when the motor operates in a reverse direction thereby acting as a generator. If the hydraulic actuator (balanced (280) or unbalanced (380), and not shown) has intermittent loads during operation this configuration allows for utilizing the stored energy over the necessary period of time during the operation. This alleviates the need for the motor (210) to instantly use the stored energy in a system that includes both the accumulator (490) and the reservoir (191). It should be noted that energy stored in or taken from the accumulator (in any form) allows for a myriad of uses including be used as a controller or together with a controller to activate or deactivate numerous devices.

For illustration purposes the flow conditions as described in FIG. 2A are provided as an example for a balanced CW mode. Specifically, FIG. 2A is a schematic that details an embodiment that is essentially identical to FIG. 4 with the exception of the addition the accumulator (490) and reversible pressurization of the previously static line from the reservoir (191) to the junction adjacent to the second optional fluid filter (165). Here again the HPU system IV (400) utilizes the motor in the CW direction so that the fluid reaches upper bi-directional port (140) to deliver fluid to a balanced hydraulic actuator (280) such as hydraulic cylinder with piston faces of equal surface areas. The fluid returns from the balanced hydraulic actuator (280) to lower bi-directional port (160). The fluids' path in this case starting with motor or motors (210) where the fluid exits the motor from the CW port (114) goes through first CW optional fluid flow filter (120). The fluid is next delivered through the second optional fluid flow filter (135) to the upper bi-directional port (140). In addition the fluid is delivered to a detented shuttle valve (150) and continues through port A (154) to port C (152). The detented shuttle valve is activated by the pressure on port A (154) moving the shuttle (157) from port A sealing "O" rings (458) to port B sealing "O" rings (459). The detented shuttle valve (150) is retained in position by the friction of the shuttle (157) against the port B sealing "O" rings (159). Flow continues and is now communicated from port A (154) to port C (152) that is connected to optional pressure measuring device (155).

In addition, flow is blocked by the shuttle (157) and port B sealing "O' rings (159) from exiting port C (156).

In this instance, there are two distinct return flow paths. The first return fluid flow path returns from the balanced hydraulic actuator (280) to lower bi-directional port (160) through optional third fluid flow filter (165) to motor (210) and specifically CCW outlet port (116) through first CCW optional fluid flow filter (122). It is critical here that the flow through the motor (210) must have an exactly equal flow entering CCW outlet port (116) as is exiting CW outlet port (114). Without this condition, the motor (210) will begin to cavitate and operate improperly or abnormally (as opposed to operating properly or normally).

The second return flow path has flow that is directed to an inverted shuttle valve (170) specifically to port D (174) which moves the primary bar-bell shaped shuttle (177) thereby closing the upper portion inverted shuttle valve (178) and opening the lower portion inverted shuttle valve (179). This allows returning flow from the lower bi-directional port (160) through the third optional fluid flow filter (165) to the inverted shuttle valve (170) but specifically to and through port E (176) thereby exiting port F (172). Completing the flow path, the flow continues to the reservoir (191). This second return flow path is reversible depending on the direction of flow into and out of the accumulator (490). Fluid of the second return path can be directed to the motor (210) and specifically to the motor seal port (112), which is a requirement for the proper operation of the motor(s) (210). What is achieved by this second return flow path is that the fluid pressure across the seal is within the manufacture's specifications. Without this static pressure equalization caused by this operation of the inverted shuttle valve (170), the shaft seals will fail.

Note that the optional pressure compensator tank (190) is connected, through fourth optional fluid flow filter (180), to the inverted shuttle valve (170) and port F (172). The pressure compensator tank (190) is a portion of the reservoir (191) (comprising the compensator tank (190), a port to ambient pressure (195) and an optional second pressure measuring device (192) measuring ambient pressure) that ensures the ability for a sealed (closed) system to operate even in the presence of unbalanced flow to and from the balanced hydraulic actuator (280). In addition, it allows for thermal expansion or compression within the sealed (closed) system. This completes the flow path within this closed system.

In addition, there is an accumulator (490) which is connected to the detented shuttle valve (150) through port C (152) as well as to the inverted shuttle valve (170) and shuttle port F (172). The flow into the accumulator (490) allows for excess flow from the motor (210) which is not being utilized by the hydraulic actuator (balanced (280) or unbalanced (380)) flows through detented shuttle valve (150) through port A (154) exiting port C(152) and is stored in the accumulator (490). Alternatively available stored energy in the accumulator (490) is available to actuate the hydraulic actuator (balanced (280) or unbalanced (380)) as needed by flow through the detented shuttle valve (150) through port C (152) exiting port A (154). Excess energy available from the hydraulic actuator (balanced (280) or unbalanced (380)) can be sorted in the accumulator (490) by flowing through the detented shuttle valve (150) going into port A (154) and exiting port C (152). Stored energy in the accumulator (490) can be utilized to generate energy as required by the motor or motors (210) by flowing through the detented shuttle valve (150) with the flow flowing into port C (152) and exiting port A (154) to the motor (210) and in this case the CW outlet port (114). This forward and reverse flow path system is operational with or without an accumulator (490).

Figure 5A:
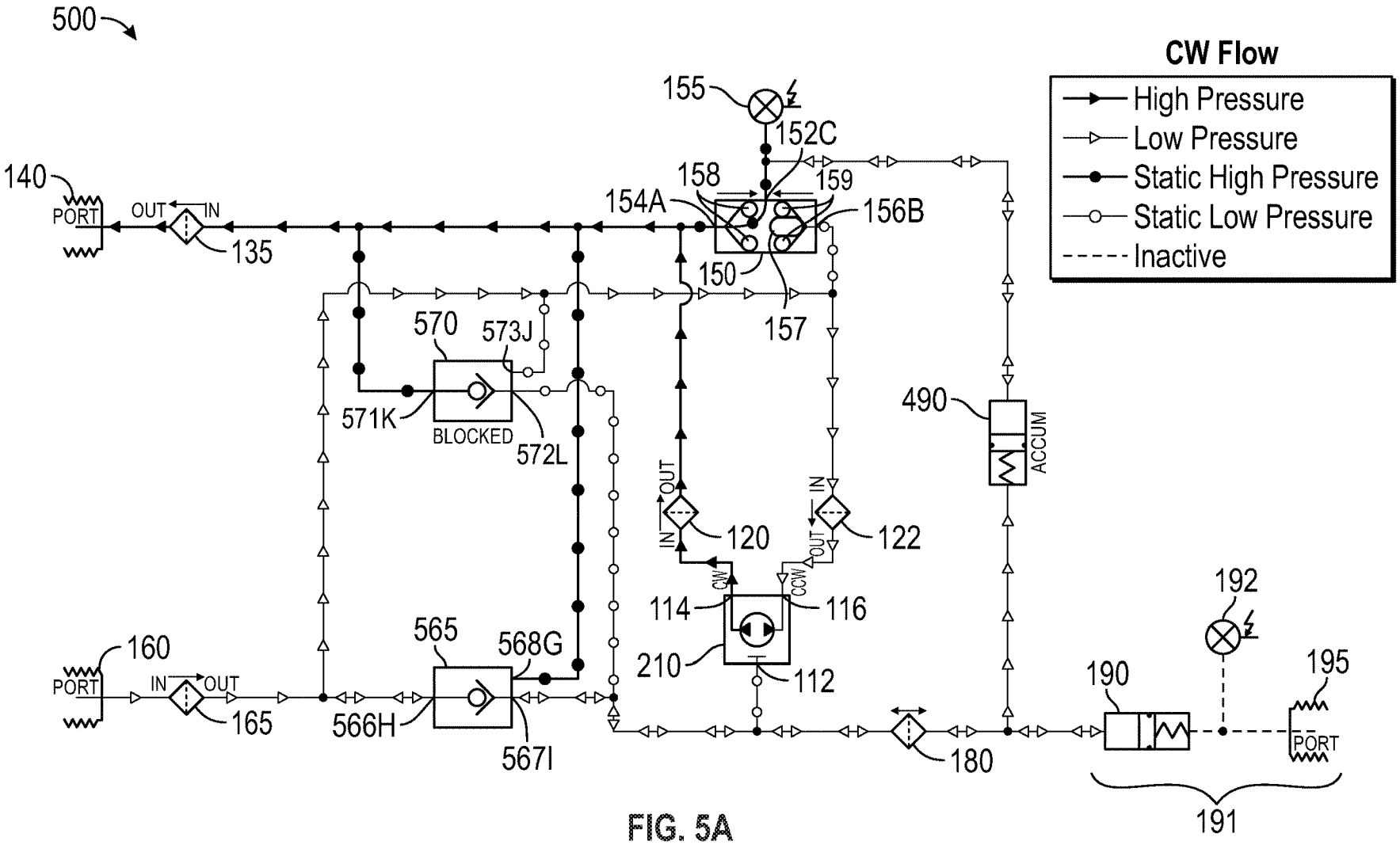
FIGS. 5A and 5C are schematic illustrations of a CW/CCW fluid-based power unit with return flow pilot check valves, illustrating a valving system according to one or more embodiments.

FIG. 5A essentially provides the same schema as FIG. 4, with the exception that the inverted shuttle valve of FIG. 4 (170) has been replaced by an upper pilot operated check valve (565) and lower pilot operated check valve (570). This valving combination provides the ability that when there is no flow through the system the pilot operated check valves (565, 570) isolate the pressure differential between the hydraulic actuator (balanced (280) or unbalanced (380), and not shown) connected to the upper bi-directional (140) and lower bi-directional port (160). This is important because pressure differentials associated with any hydraulic actuators (balanced (280) or unbalanced (380)) allow for these pilot operated check valves (565, 570) to ensure the pressure compensator tank (190) does not receive large, potentially damaging, pressure differences that may occur and migrate through the system during operation. In this manner, the pilot operated check valves (565, 570) operate as a form of safety valves—providing protection from damaging, in this case the pressure compensator tank (190).

FIG. 5A is a schematic which is also identical to FIG. 2A and FIG. 3A with the addition of an accumulator (490). The accumulator (490) can store energy that allows intermittent operation of the motor or motors (210) as required. In addition the accumulator (490) can store energy available from the hydraulic actuator (balanced (280) or unbalanced (380), and not shown) to be utilized by the motor (210) when the motor operates in a reverse direction thereby acting as a generator. In this case no hydraulic actuator (balanced (280) or unbalanced (380)) is shown, but again there may be and often are intermittent loads during operation. This configuration allows for utilizing the stored energy over the necessary period of time during the operation. This alleviates the need for the motor to instantly use the stored energy in the system.

For illustration purposes the flow conditions are as described in FIG. 2A, FIG. 3A and FIG. 4 and is provided as an example for a CW flow. Here again the HPU system V (500) utilizes the motor (210) in the CW direction so that the fluid reaches the upper bi-directional port (140) to deliver fluid to an actuator or other user device (not shown). The fluid returns from the lower bi-directional port (160) after exiting the upper bi-directional port (140) from the user device (not shown). The fluid path in this case is as follows; starting with the fluid flowing from the motor or motors (210), exits the motor from the CW outlet port (114) and proceeds through the first optional fluid flow filter (120) in the CW direction. The fluid is next delivered through the second optional fluid flow filter (135) to the upper bi-directional port (140). In addition, the fluid is delivered to a detented shuttle valve (150) and continues through port A (154) to port C (152). The detented shuttle valve is activated by the pressure on port A (154) moving the shuttle (157) from port A sealing "O" rings (158), located near port A (154) to port B sealing "O" rings (159) located near port B (156). The detented shuttle valve (150) is retained in position by the friction of the shuttle (157) against the port B sealing "O" rings (159). Flow continues and is now communicated from port A (154) to port C (152) so that it is in communication with an optional pressure measuring device (155).

In addition, flow is blocked by the shuttle (157) and the port B sealing "O' rings (159) from exiting shuttle valve port B (156). In this case there is also an upper pilot operated check valve (570) which is in the blocked condition.

In this instance, there are two distinct return flow paths. The first return fluid flow path returns from the actuator (not shown) to the lower bi-directional port (160) through optional third fluid flow filter (165) to motor (210) and specifically the CCW outlet port (116) through first CCW optional fluid flow filter (122). It is critical here that the flow through hydraulic motor (210) must have an exactly equal flow entering the CCW outlet port (116) as is exiting the CW outlet port (114). Without this condition, the motor will begin to cavitate and operate improperly or abnormally (as opposed to operating properly or normally).

Figure 5B:
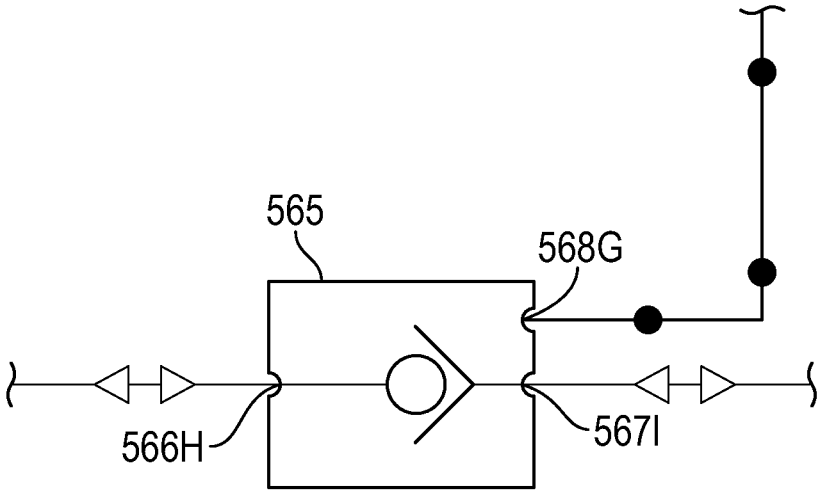
FIGS. 5B and 5D provide detailed enlarged portions of the valve components of FIGS. 5A and 5C.

The second return flow path is enabled by the high pressure flow line connected to the lower pilot operated check valve (565), as provided in detail in FIG. 5B, specifically to lower pilot operated check valve port G, herein port G (568) which opens the lower pilot operated check valve (565) allowing bi-directional flow between lower pilot operated check valve port H, herein port H (566) and lower pilot operated check valve port I, herein port I (567). This allows returning flow from the lower bi-directional port (160) through the third optional fluid flow filter (135) to the lower pilot operated check valve (565) but specifically to and through port H (566) thereby exiting port I (567). Completing the flow path, the flow continues to the motor (210) which is a requirement for the proper operation of the motor(s) (210). What is achieved by this second return flow path is that the fluid pressure across the seal maintains the pressure so that it is within the manufacture's specifications. Without this static and dynamic pressure equalization caused by this operation of the lower and upper pilot operated check valves (565, 570) of inverted shuttle valve (170), the internal motor shaft seals—which must be properly pressurized (not shown)—will fail.

Again, there is an optional pressure compensator tank (190) that is connected to the lower pilot operated check valves (565) and port G (568). The pressure compensator tank (190) is a portion of the reservoir (191) (comprising the compensator tank (190), a port to ambient pressure (195) and a second optional pressure measuring device (192) measuring ambient pressure) that ensures the ability for a sealed (closed) system to operate even in the presence of unbalanced flow to and from the balanced hydraulic actuator (280). In addition, it allows for thermal expansion or compression within the sealed (closed) system. This completes the flow path within this closed system.

In addition, there is an accumulator (490) which is connected to the detented shuttle valve (150) through port C (152) as well as to both the lower and upper pilot operated check valves (565, 570). The flow into the accumulator (490) allows for excess flow from the motor or motors (210) which is not being utilized by the hydraulic actuator (balanced (280) or unbalanced (380), and not shown) which flows through detented shuttle valve (150) through port A (154) exiting port C (152) and is stored in the accumulator (490). Alternatively available stored energy in accumulator (490) is available to actuate the hydraulic actuator (balanced (280) or unbalanced (380), not shown) as needed by flow through the detented shuttle valve (150) through port C (152) exiting port A (154). Excess energy available from the hydraulic actuator (balanced (280) or unbalanced (380), not shown) can be stored in the accumulator (490) by flowing through the detented shuttle valve (150) going into port A (154) and exiting port C (152). Stored energy in the accumulator (490) can be utilized to generate energy as required by the motor (210) by flowing through the detented shuttle valve (150) with the flow flowing into port C (152) and exiting port A (154) to the motor (210) and in this case the CW outlet port (114). This forward and reverse flow path system is operational with or without an accumulator (490).

In addition, flow is blocked by a shuttle (157) and port B sealing "O' rings (159) from exiting port B (156). In this case there is also an upper pilot operated check valve (570) which is in the blocked condition.

Figure 5C:
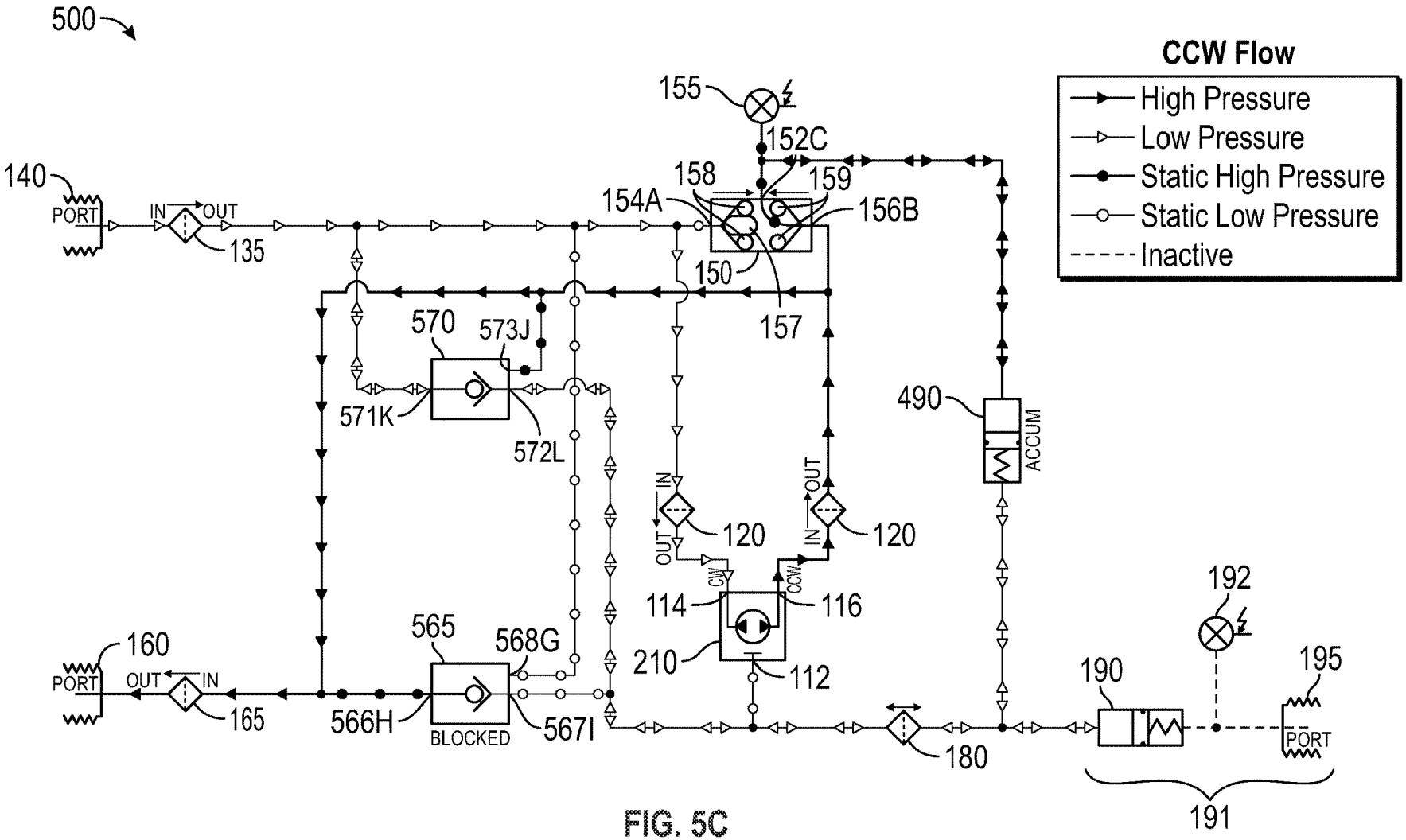
Figure 5D:
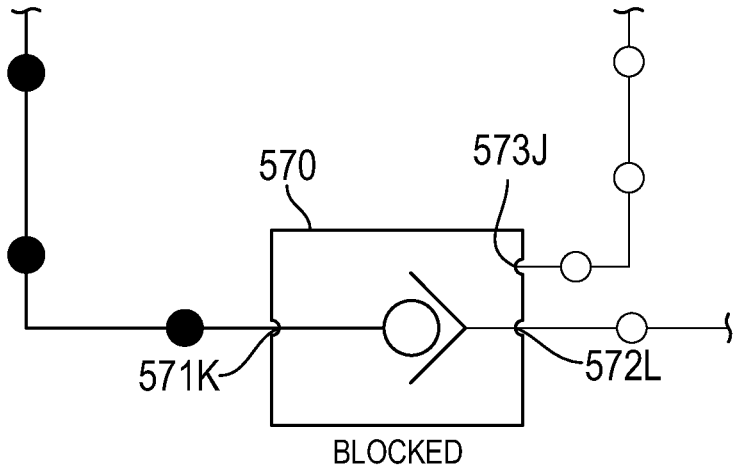

For FIG. 5C the system now operates in the CCW direction with the same condition existing regarding the second return flow path in that it is enabled by the high pressure flow line connected to the upper pilot operated check valve (570) specifically to upper pilot operated check valve port J, herein port J (573) which opens the upper pilot operated check valve (570), shown in further detail in FIG. 5D, allowing bi-directional flow between the upper pilot operated check valve port K, herein port K (571) and upper pilot operated check valve port L, herein port L (572). This allows returning flow from the upper bi-directional port (140) through second optional fluid flow filter (135) to the upper pilot operated check valve (570) but specifically to and through port K (571) thereby exiting port L (572). Completing the flow path the flow continues to motor (210) which is a requirement for the proper operation of the motor(s) (210) as described. In contrast to FIG. 5A, the lower pilot operated check valve (565) is in the blocked condition.

Further for FIG. 5C, there are two distinct return flow paths. The first return fluid flow path returns from the actuator (not shown) to the lower bi-directional port (160) through the third optional fluid flow filter (165) to the motor (210) and specifically CCW outlet port (116) through the first optional fluid flow filter (122). It is critical here that the flow through the motor (210) must have an exactly equal flow entering CW outlet port (114) as is exiting CCW outlet port (116). Without this condition, the motor (210) will begin to cavitate and operate improperly or abnormally (as opposed to operating properly or normally).

Figure 6A:
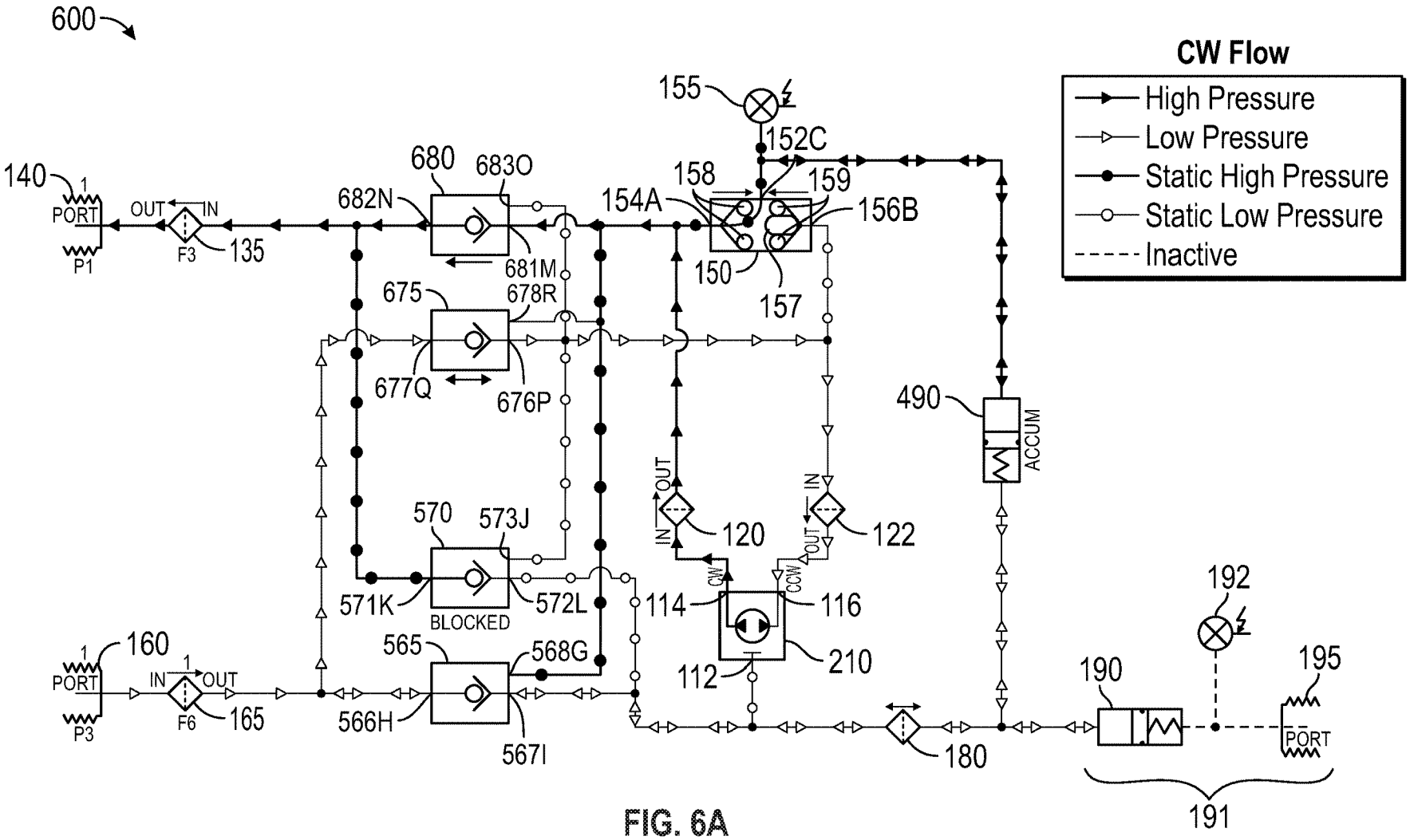
FIGS. 6A, 6C and 6D are schematic illustrations of a CW/CCW fluid-based power unit with pressure blocking pilot check valves, illustrating a valving system according to one or more embodiments.
Figure 6B:
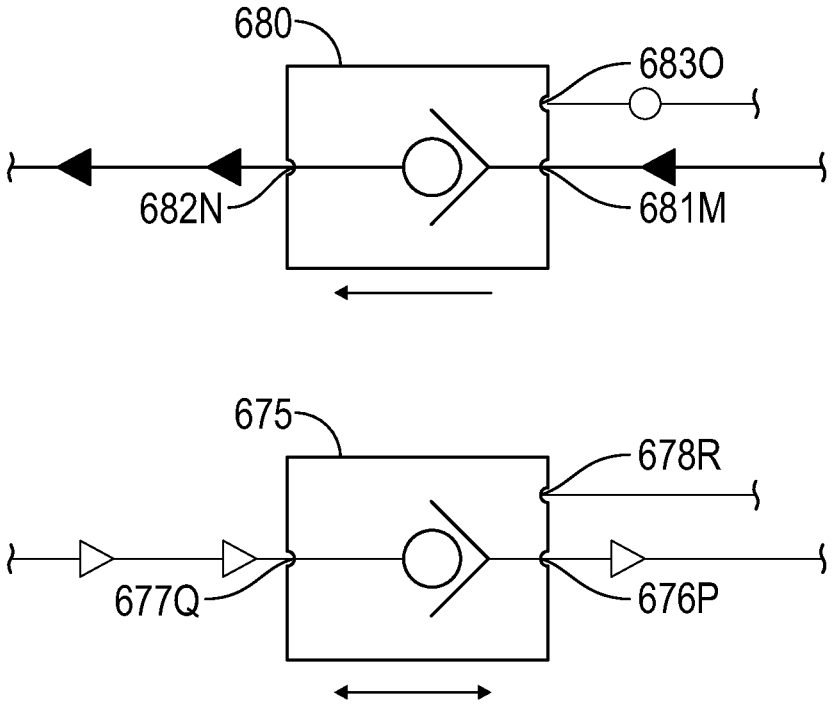
FIG. 6B provides detailed enlarged portions of the valve components of FIGS. 6A, 6C and 6D.

For FIG. 6A, HPU system VI (600) is provided, referring back to FIG. 5A with the addition of a single pair of second upper and lower pilot operated check valves (shown as (680) and (675) respectively) with the purpose of blocking and isolating the actuator or user device (not shown) which would reside between the upper and lower bi-directional ports (140 and 160). The flow path differs from FIG. 5A (CW flow direction) as follows; in this case, flow from the motor (210) and out of the CW outlet port (114) is directed through the second upper pilot operated check valve (680), as provided in expanded detail in FIG. 6B, to upper bi-directional port (140). Specifically entering second upper pilot operated check valve port M, herein port M (681) and exiting second upper pilot operated check valve port N, herein port N (682) in the forward flow direction of the second upper pilot operated check valve (680). The pressure on the second upper pilot operated check valve port O, herein port O (683) is inconsequential in this specific mode (static low pressure).

Regarding the first returning flow path from the lower bi-directional port (160), fluid flows through lower pilot operated check valve (565) specifically entering port H (566) exiting port I (567) and proceeding to the motor (210) and to the outlet CCW port (116). This flow path is enabled by the high pressure flow line connected to the lower pilot operated check valve (565) specifically to pilot port (678) which opens check valve (675) allowing bi-directional flow between ports (677) and (676). The second returning flow path is unchanged from that described above in FIG. 5A.

Figure 6C:
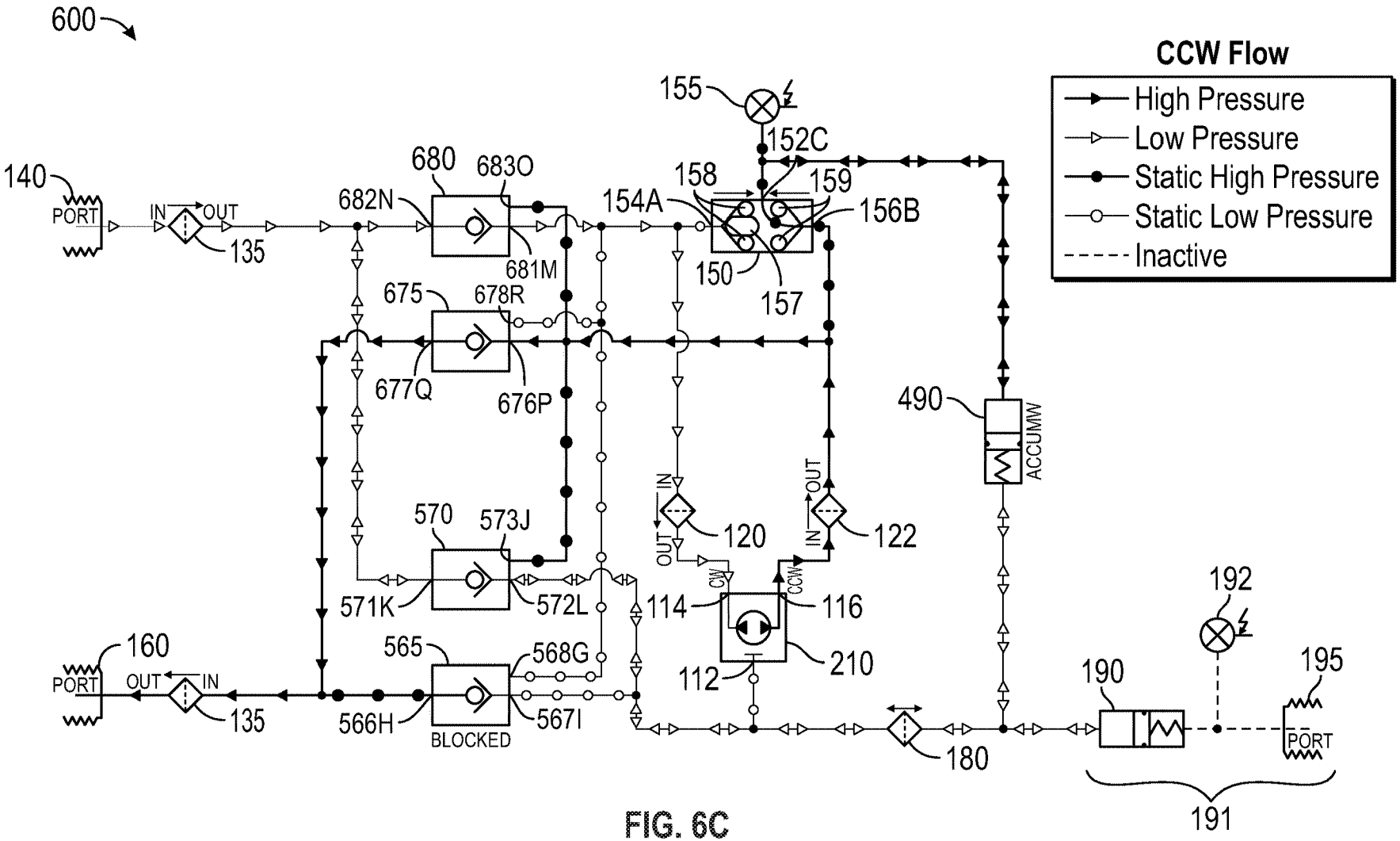

For FIG. 6C flow is in the opposite direction from that shown in FIG. 6A. Referring back to FIG. 5C, FIG. 6C provides the addition of a single pair of second upper and lower pilot operated check valves shown as (680 and 675) with the purpose of blocking and isolating the actuator or user device (not shown) which would reside between the upper and lower bi-directional ports (140 and 160). The flow path differs from FIG. 5C (CCW flow direction) as follows; in this case, flow from the motor (210) and out of the CCW outlet port (116) is directed through the second lower pilot operated check valve (675) to the lower bi-directional port (160). Specifically entering, as provided in detail in FIG. 6B, the second lower pilot operated check valve port P, herein port P (676) and exiting the second lower pilot operated check valve port Q, herein port Q (677) in the forward flow direction of the second lower pilot operated check valve (675). The pressure on the second lower pilot operated check valve port R, herein port R (678) is inconsequential in this specific mode.

Regarding the first returning flow path from the upper bi-directional port (140), fluid flows through second upper pilot operated check valve (680) specifically entering port N (682) exiting port M (681) and proceeding into the motor (210) and CW outlet port (114). This flow path is enabled by the high pressure static line connected to the second upper pilot operated check valve (680) specifically to pilot port O (683) which opens the second upper pilot operated check valve (680) allowing bi-directional flow between ports M and N (681) and (682) respectively. The second returning flow path is unchanged from that described above in FIG. 5C.

Figure 6D:
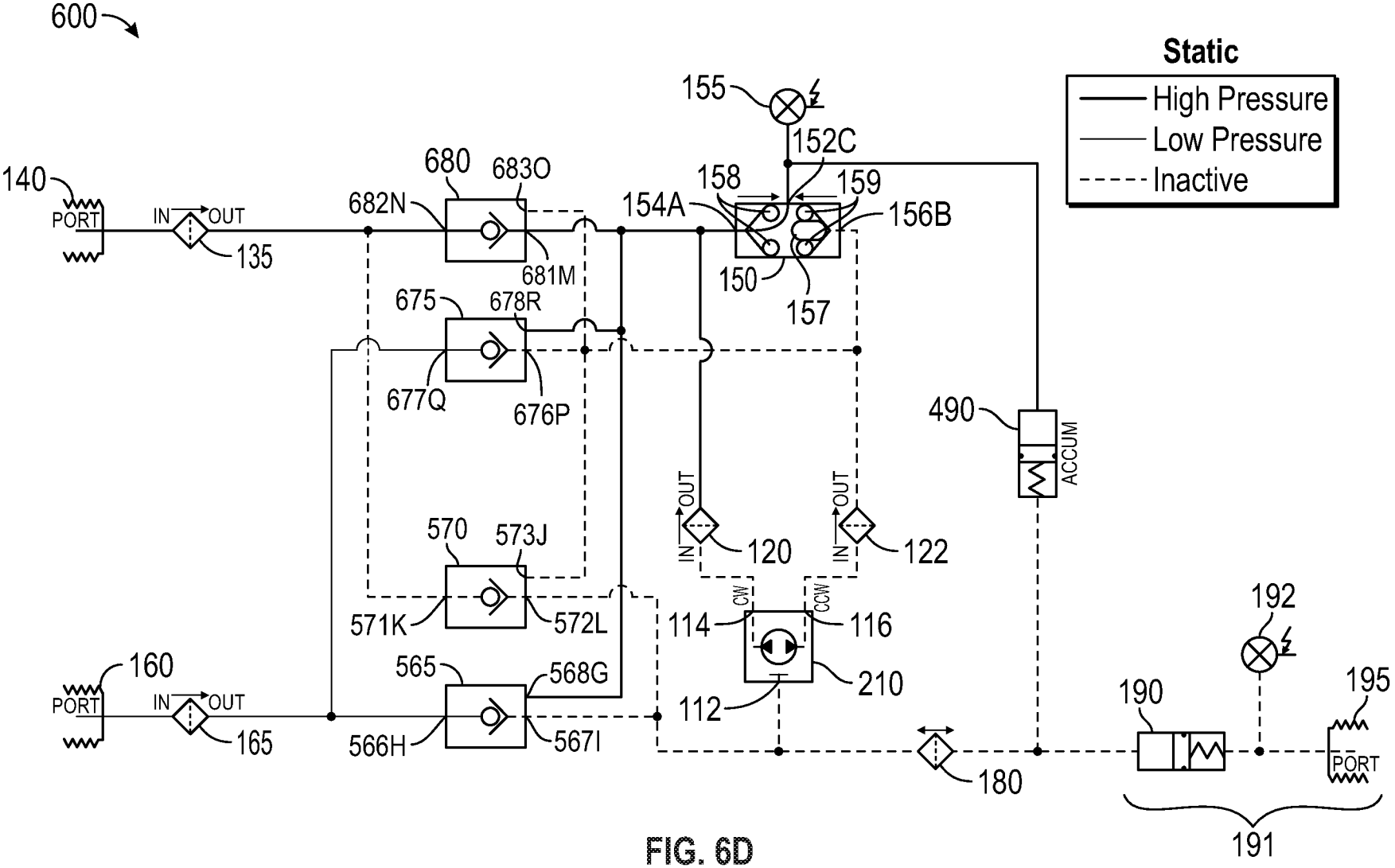

FIG. 6D illustrates the same schema as FIGS. 6A and 5C, however in a completely static flow situation which provides for blocking of flows and pressures to and from the upper and lower bi-directional ports (140) and (160). In this instance, leakage through the motor seal inlet port (112) occurs and drains the high pressure from the CW outlet and CCW outlet ports (114 and 116). This relieves pressure from all pilot operated check valve (570, 565, 675, 680) ports (668, 673, 678, 683). Control of the speed and time for which pressure drainage occurs is also part of the present disclosure.

Figure 7A:
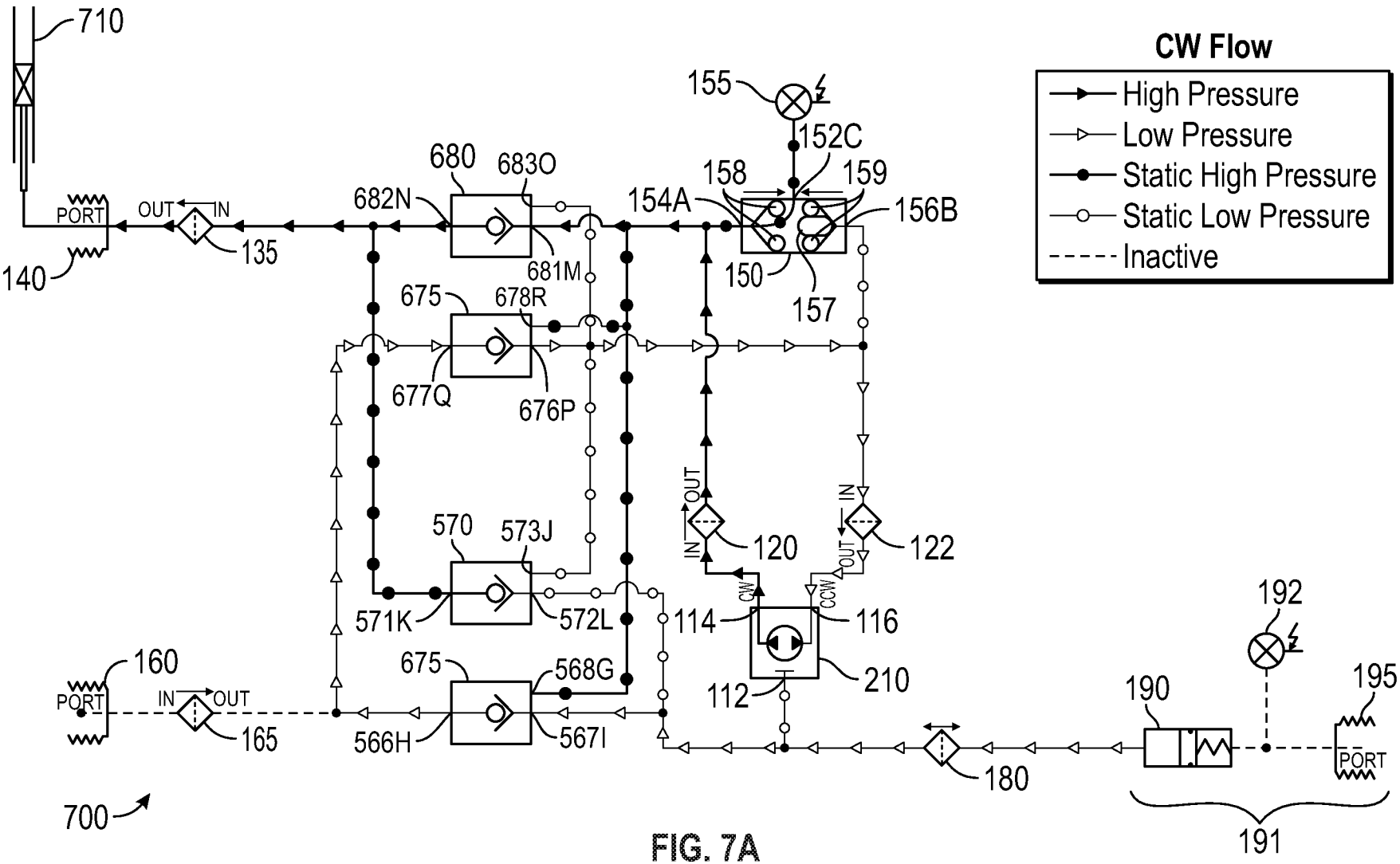
FIGS. 7A and 7B are schematic illustrations of a CW/CCW fluid-based power unit with pressure blocking pilot check valves connected to a single ended flow device, illustrating a valving system according to one or more embodiments.
Figure 7B:
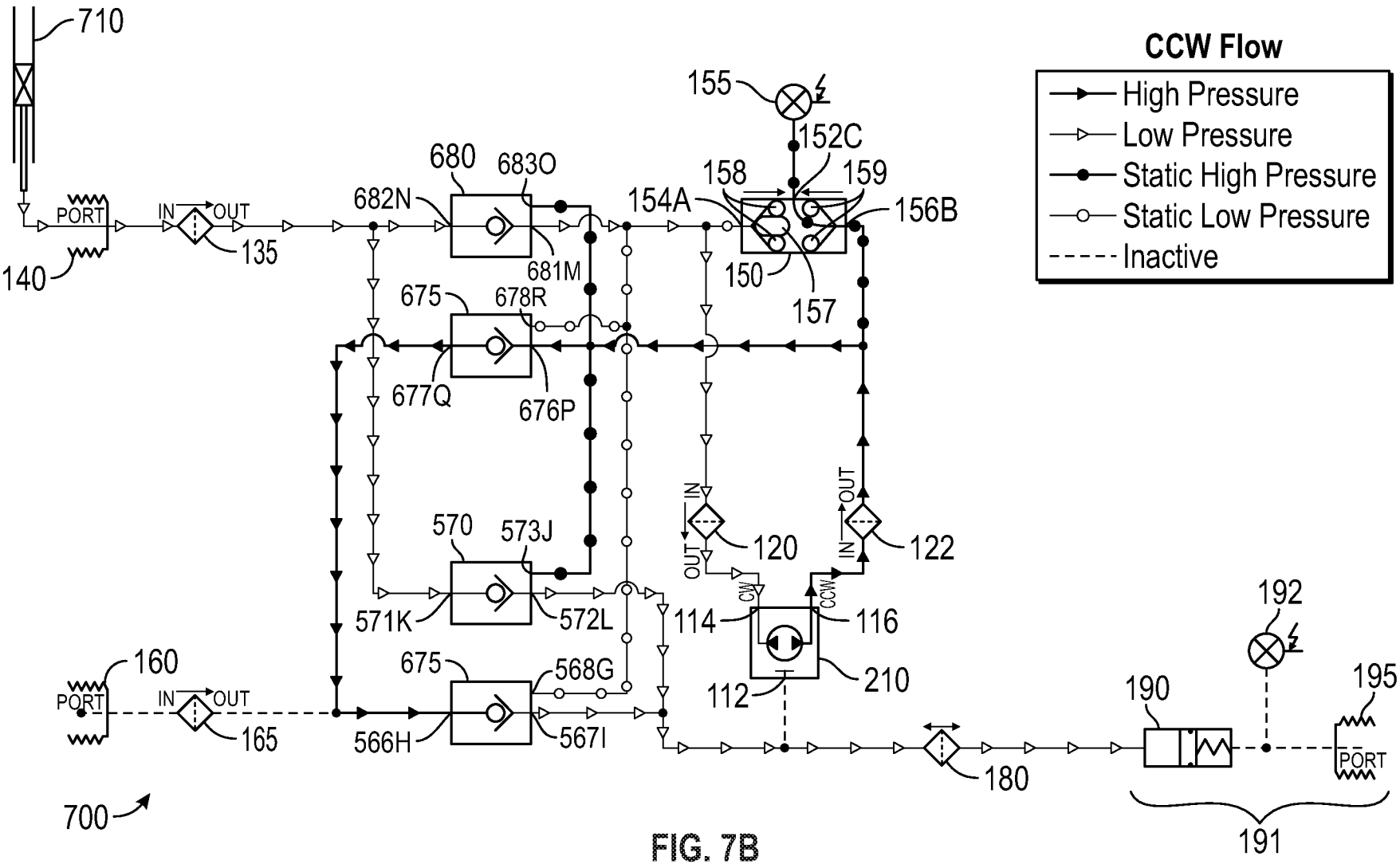

FIGS. 7A and 7B, HPU system VII (700) generating a CW and CCW fluid flow, are identical to schemas as presented in FIGS. 6A and 6C with the exception that the lower bi-directional port (160) is blocked and unused or may be connected to a small single ended piston to "unlock" one or more mechanical features of the packer (not shown). This is a particular system that is useful for some hydraulic devices such as packer devices (710) which may exist with only singular hydraulic ports. FIG. 7A is for flow in the CW direction and FIG. 7B is for flow in the CCW direction. In the CW direction, there is fluid supplied from the reservoir (191) to the hydraulic device, shown as packer device (710). Alternatively in the CCW direction, fluids are removed from the hydraulic device, shown as packer device (710) and sent back to the reservoir (191) without going through the motor (210).

Figure 7C:
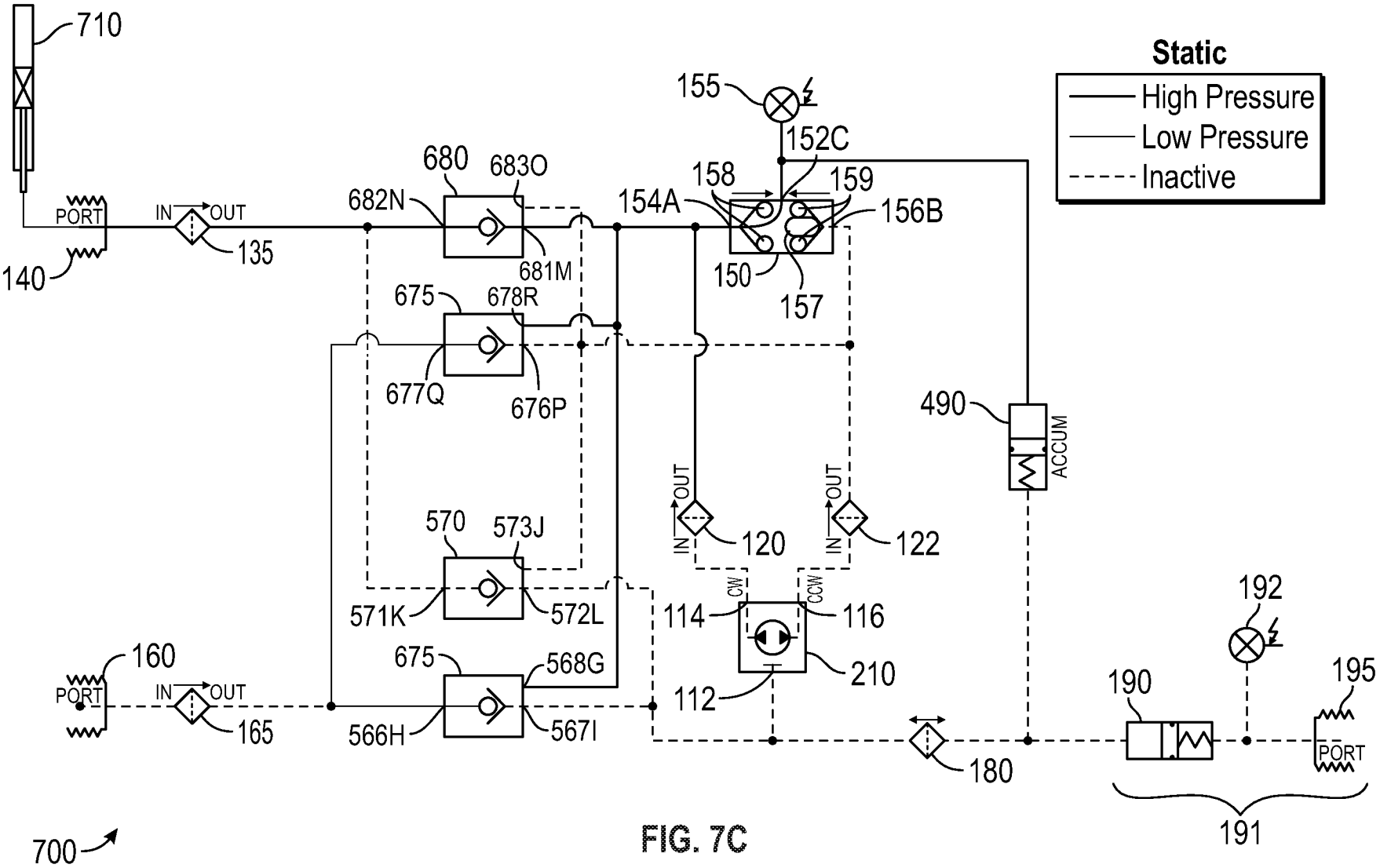
FIG. 7C is a schematic illustration of a static fluid-based power unit, illustrating a valving system according to one or more embodiments.

FIG. 7C illustrates the same schema as FIGS. 7A and 7B with the condition that the pilot operated check valves (570, 575, 675, 680) are blocking to ensure no movement (i.e. stationary condition) of the packer device (710) without any energy requirement from the motor (210).

Figure 8:
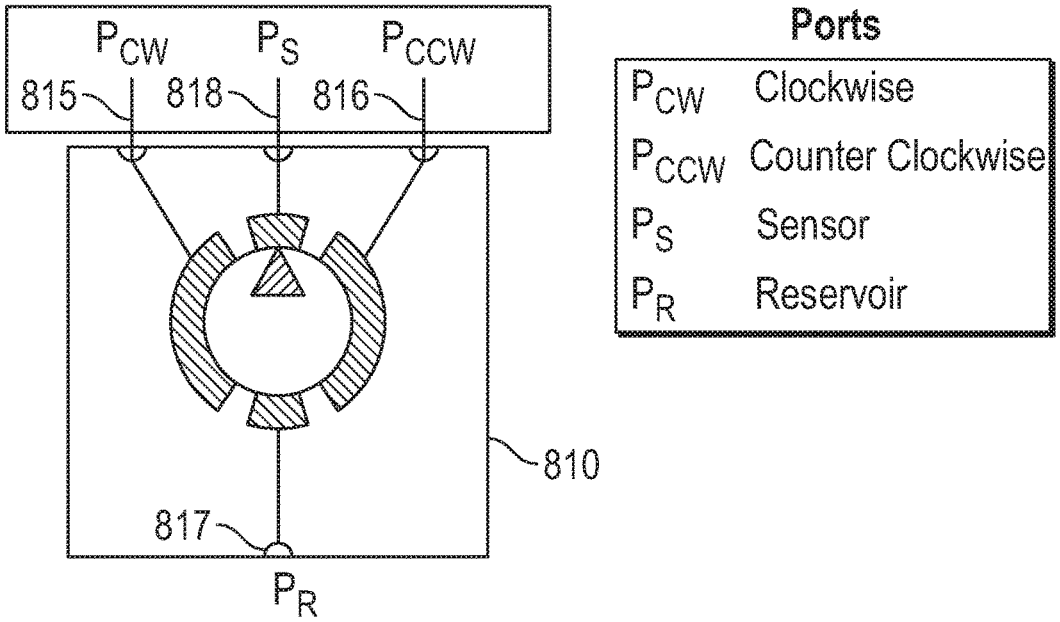
FIG. 8 is a schematic of a multiport pump that provides an integrated functionality which reduces or eliminates the need for a set of valves.

FIG. 8 is a schematic of a multiport pump symbolized (810) as shown that provides an integrated functionality of both an inverse shuttle valve and a detented shuttle valve. In this instance the pump is a four-port pump which includes four ports that allow for flow into or out of the multiport pump; a clockwise inlet/outlet port $P_{CW}$ (815), a counter-clockwise inlet/outlet port Pccw (816), a reservoir connection inlet/outlet port $P_R$ (817) and sensor inlet/outlet port $P_S$ (818) which allows for monitoring and sensing pressure, temperature, and actuation of devices.

Figure 9:
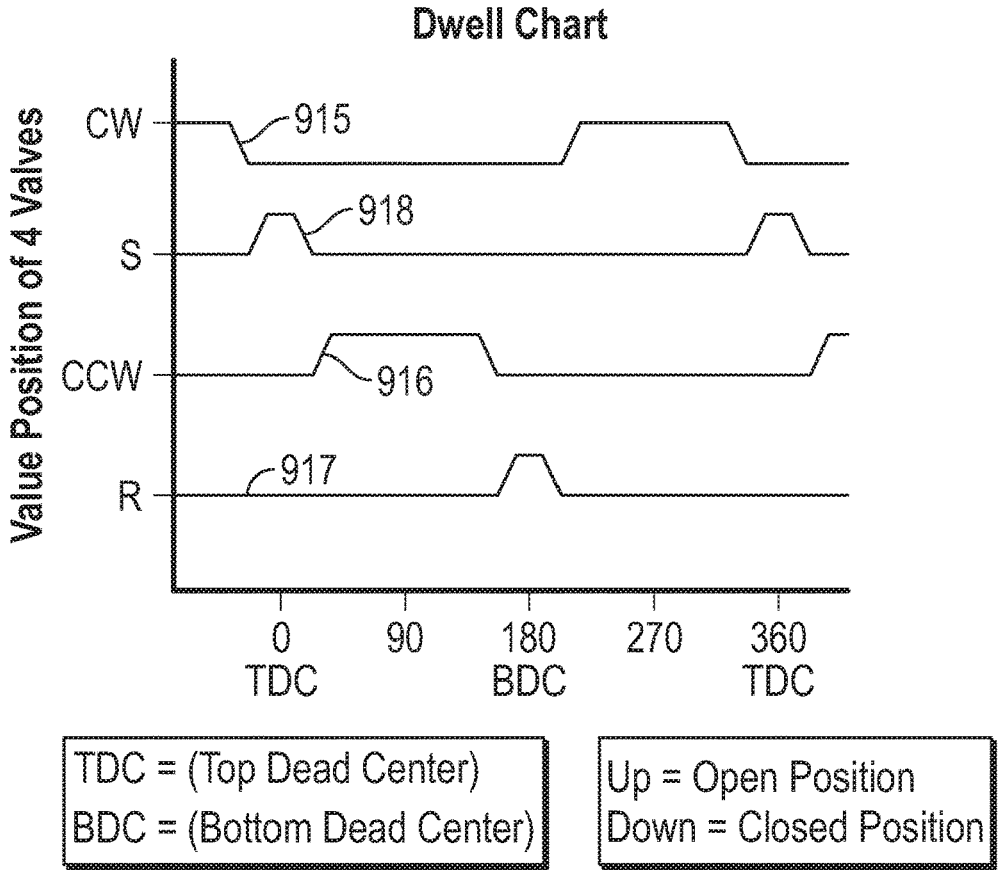
FIG. 9 is a dwell curve chart of the valve operation of the multiport pump shown in FIG. 8.

FIG. 9 is a dwell curve chart of the valve operation of the multiport pump. In this instance, the horizontal axis represents the angular rotation of the pump drive shaft from zero (o) degrees being a piston at top dead center (TDC) to 180 degrees being a piston at bottom dead center (BDC) through a full rotation of 360 degrees (thus allowing return of any one of the pistons to top dead center—TDC). The vertical axis comprises four separate dwell curves for each of the four valves and associated position of the pistons that correspond with the outlet ports of FIG. 8. Here (915) is the curve for the clockwise valve port (815), (916) is the curve for the counterclockwise valve port (816), (917) is the curve for the reservoir valve port (817) and (918) is the curve for the sensor port (818). The representation of each dwell curve of the valve operation shows the valve in either an open (associated with up) or closed (associated with down) position.

Figures 10A, 10B, 10C, 10D:
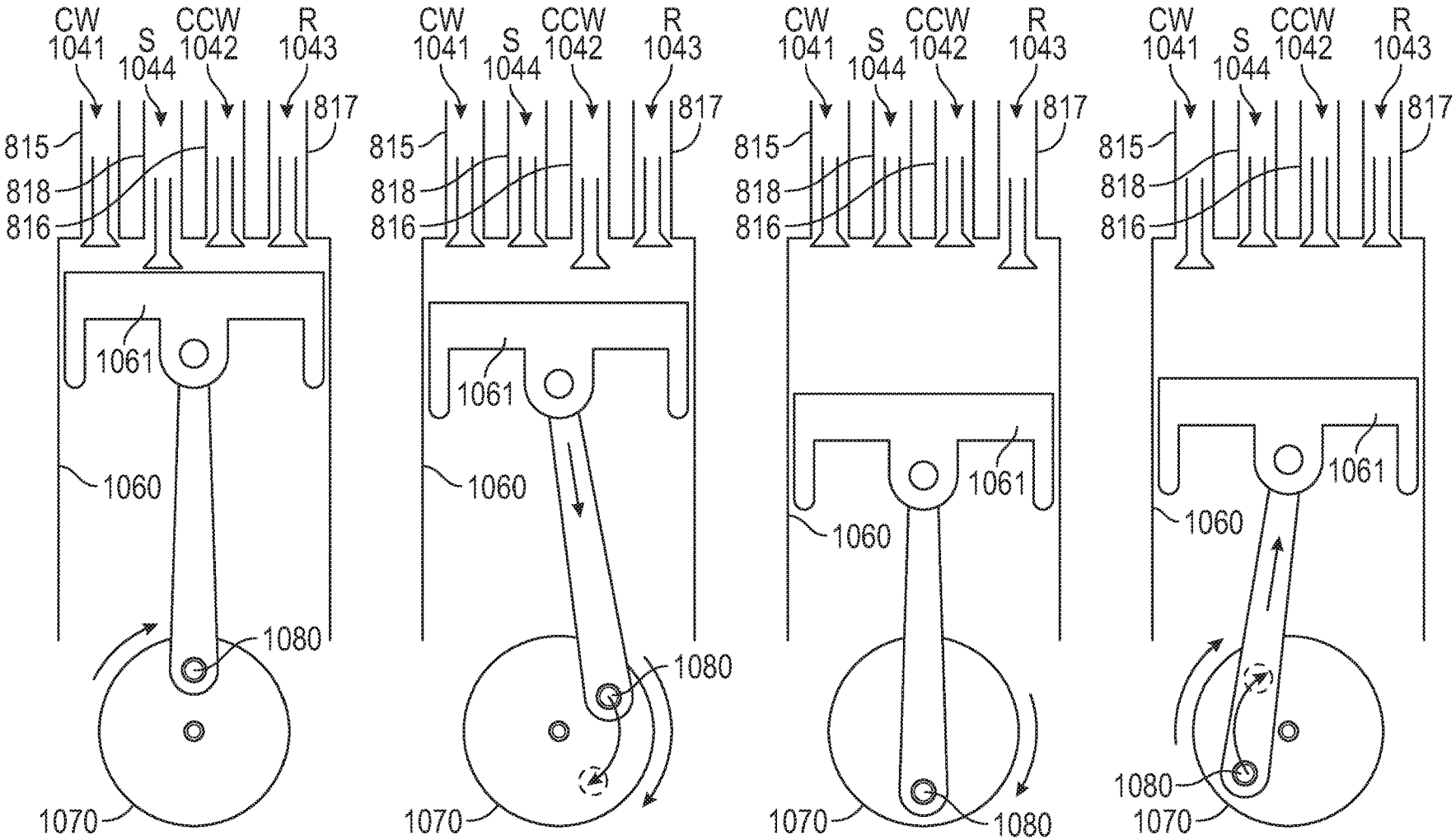
FIGS. 10(A-D) are schematics that provides a step-by-step movement of a single piston with its associated valves as the multiport pump operates according to the dwell curve chart of FIG. 9.

FIG. 10 is a schematic of the movement of a single piston with its associated valves as the multiport pump operates according to the dwell curve of FIG. 9. In this case, 1060 is the piston bore with piston (1061) operating inside the bore (1060). The crank mechanism (1070) moves the piston (1061) along the path provided by the dwell curve. This schematic represents the movement through one complete cycle of the piston beginning at 0 and completed at 360 degrees. The piston's position is controlled by its attachment to a piston rod coupling through a piston pin (1080) with the movement of the crank mechanism (1070). The four valve curves described above for FIG. 9 correspond with the operation of four valves, a clockwise rotating valve (1041), a counterclockwise rotating valve, (1042), a reservoir valve (1043) and a sensor valve (1044), which are all connected to the piston bore that moves according to the dwell curve. Corresponding with the four valves (1041, 1042, 1043, and 1044) are four ports; a clockwise inlet/outlet port $P_{CW}$ (815), a counterclockwise inlet/outlet port Pccw (816), a reservoir connection inlet/outlet port $P_R$ (817) and sensor inlet/outlet port $P_S$ (818). For FIG. 10A, the piston (1061) is at top dead center (TDC—dwell angle 0). As indicated in the dwell curve (918), the sensor valve (1044) is opened and all other valves are closed. This connects the pressure within the piston bore (1060) at TDC to the sensor port (818).

For FIG. 10B, the piston (1061) moves toward bottom dead center (BDC) and in this instance the sensor valve (1044) closes as indicated in the dwell curve portion (918), and the counterclockwise valve (1042) opens according to the dwell curve portion (916). This connects the pressure within the piston bore (1060) to the counterclockwise port (816). As the piston (1061) moves through this piston bore, fluid enters from the ccw port (816) from the moving devices.

For FIG. 10C, the piston (1061) is at bottom dead center (BDC) and as indicated in the dwell curve (917), the reservoir valve (1043) is opened and all other valves are closed. This connects the pressure within the piston bore (1060) at BDC to the reservoir port (817). In this manner any excess or deficient fluid or fluid flow is provided by the reservoir.

For FIG. 10D, the piston (1061) moves toward top dead center (TDC) and in this instance the reservoir valve (1043) closes as indicated in dwell curve portion (917), and the clockwise valve (1041) opens according to the dwell curve portion (915). This connects the pressure within the piston bore (1060) to the clockwise port (815). As the piston (1061) moves through this piston bore, fluid exits from the clockwise port (816) and flows toward the moving devices.

This completes the full cycle of a single piston cylinder combination and its associated valves for the multiport pump.

Figure 11A:
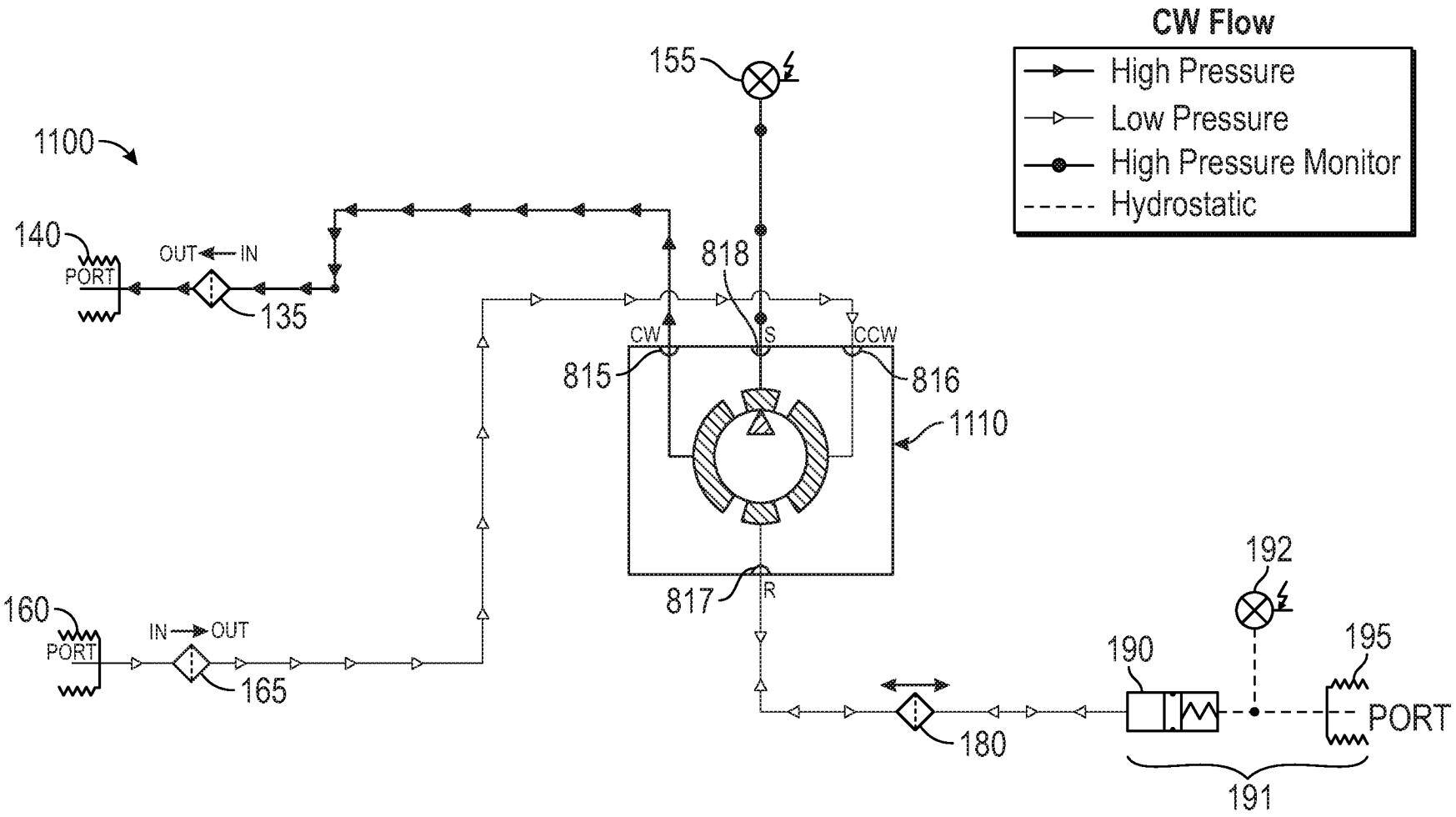
FIGS. 11A-D are schematics that provide other embodiments of the present disclosure illustrating the HPU system that utilizes the multiport pump as shown and described in FIG. 8.

FIG. 11A is a schematic that provides another embodiment of the present disclosure illustrating the HPU system (1100) utilizing one or more multiport pressure pumps (1110), as described in FIGS. 8, 9, and 10, that operate utilizing CW (clockwise) or CCW (counter clockwise) rotation, to accomplish supplying high pressure fluid to a mechanical (user) device and returning low pressure fluid from the device back to at least one pump. As before this system is referred to as a hydraulic power unit (HPU) that powers the prime mover. The power unit (PU) could also be driven by electrical power derived from various sources including wind and solar energy.

Here the HPU system (1100) utilizes the pump (1110), having multiple ports (815, 816, 817, and 818) as described in FIG. 8. When the pump is rotating in the CW direction the fluid reaches the upper bi-directional port (140) and is delivered to the mechanical (user) device and returns from the mechanical (user) device into lower bi-directional port (160). Although the system described is directed to moving mechanical (user) devices, it is to be understood that the prime mover concept taught herein is also applicable to moving devices that are not mechanical.

The fluids' path in this case starts with one or more pump or pumps (1110) such that the fluid exits the pump (1110) from the CW outlet port (815). The fluid is delivered through the second optional fluid flow filter (135) to the upper bi-directional port (140). The pressure sensor (155) is connected to the pump (1110) sensor port (818) to monitor the operation of the pump and system.

Flow from the user device returns from the lower bi-directional port (160) through optional fluid flow filter (165) and returns directly to the multiport pump (1110) through port (816).

Note that the pressure compensator tank (190) is operationally connected to the reservoir port (817) through the optional fourth fluid flow filter (180). The compensator is a portion of the reservoir (191) (comprising the compensator tank (190), a port to ambient pressure (195) and an optional reservoir pressure measuring device (192)) for measuring ambient pressure that ensures the ability for a sealed (closed) system to operate even in the presence of unbalanced flow to and from the mechanical (user) device. In addition, it allows for thermal expansion or compression within the sealed (closed) system. This completes the flow path within this closed system. It is also possible that a flow path is provided by simply submersing the pump in a reservoir tank such that the reservoir port is connected to the reservoir fluid to allow for proper operation of the HPU.

Figure 11C:
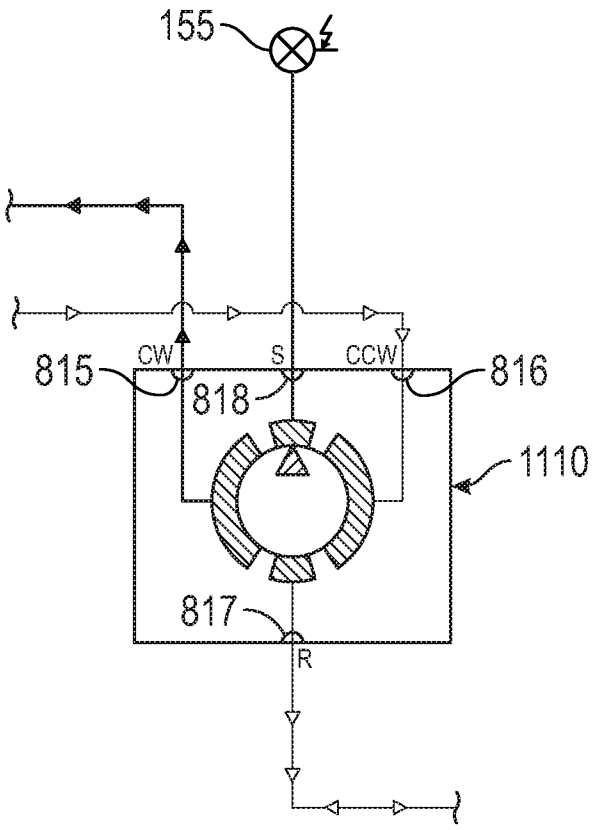
Figure 11B:
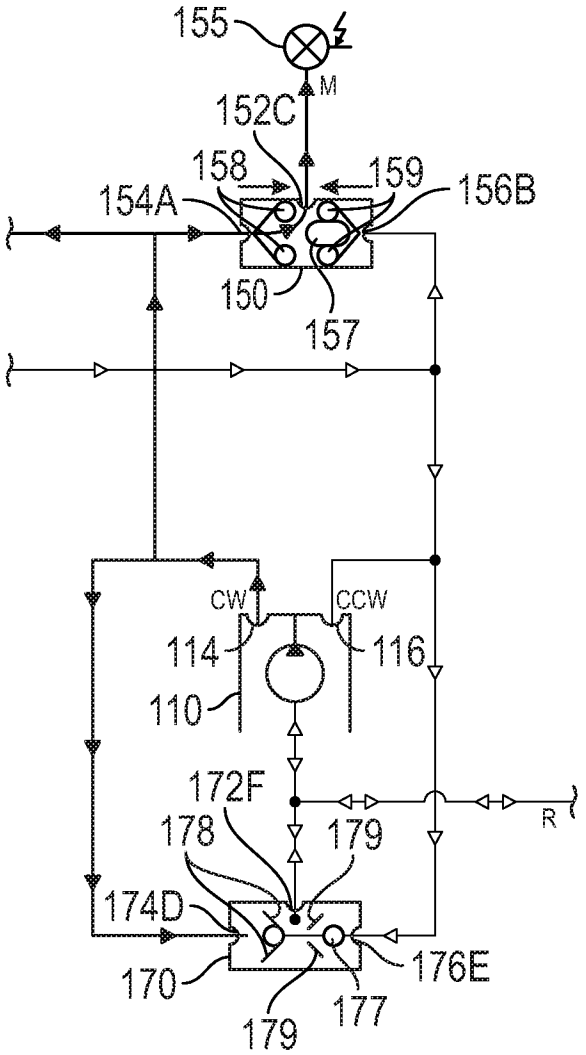

For FIG. 11B, the functionality is identical to that described above in FIG. 2A. In this case, however, the bidirectional pump (110), the inverse shuttle valve (170) and the detented shuttle valve (150) have been replaced by the multiport pump (1110) as shown in FIG. 11C.

Figure 11D:
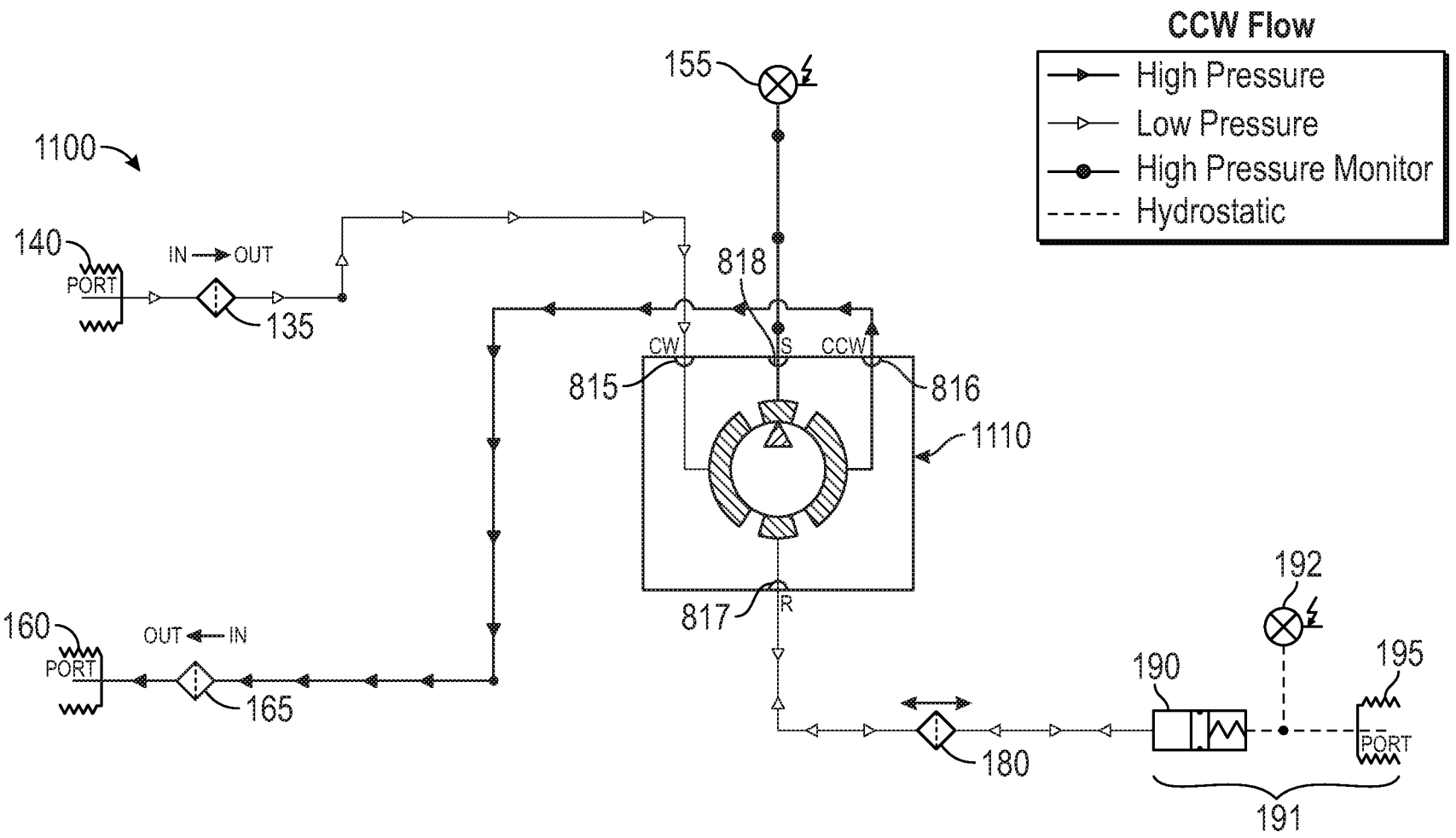

For FIG. 11D, the HPU system (1100) utilizes the pump (1110), having multiple ports (815, 816, 817, and 818) as described in FIG. 8. When the pump is rotating in the CCW direction the fluid reaches the lower bi-directional port (160) and is delivered to the mechanical (user) device and returns from the mechanical (user) device into upper bi-directional port (140).

The fluids' path in this case starts with one or more pump or pumps (1110) such that the fluid exits the pump (1110) from the CCW outlet port (816). The fluid is delivered through the second optional fluid flow filter (165) to the lower bi-directional port (160). The pressure sensor (155) is connected to the pump (1110) sensor port (818) to monitor the operation of the pump and system.

Flow from the user device returns from the upper bi-directional port (140) through optional fluid flow filter (135) and returns directly to the multiport pump (1110) through port (815).

The reservoir port (817) is connected identically to that described above for FIG. 11A.

In some embodiments, the devices and systems described herein can be configured for use only as an expansion device. For example, an expansion device as described herein can be used to generate electricity or to modify the pressure of a fluid, also referred to as pressure regulation. In some embodiments, an expansion device as described herein can be used in a natural gas transmission and distribution system or an oil recovery system or both. For example, at the intersection of a high pressure (e.g., 500 psi) transmission system and a low pressure (e.g., 50 psi) distribution system, energy can be released where the pressure is stepped down from the high pressure to a low pressure. An expansion device as described herein can use the pressure differential to generate electricity. In other embodiments, an expansion device as described herein can be used in other gas systems to harness the energy from high to low pressure regulation. By use of the bi-directional capabilities of the system(s) described herein, it is possible to provide compression and/or expansion devices (also referred to herein as "compression/expansion devices") according to an embodiment. A compression/expansion device can include one or more pneumatic cylinders, one or more pistons, at least one actuator, a controller and, optionally, a liquid management system such as a reservoir. The compression/expansion devices can be used, for example, in a compressed air energy storage (CAES) system.

A system for compression and/or expansion of fluids can include any suitable combination of systems or portions thereof, described in FIGS. 1-11 above. For example, in some embodiments, such a system can include any combination of system elements. For example, a system can include two or more valves or valve combinations in an in-line configuration and/or two or more valves in a stacked configuration. Additionally, a system can include one, two, three, four, or more valves per stage of compression/expansion required to achieve the necessary movement of the mechanical (user) devices as determined by the user.

The devices and systems described herein can be implemented in a wide range of sizes and operating configurations. In other words, the physics and fluid mechanics of the system do not depend on a particular system size. This estimated power range results from a system design constrained to use current commercially available components, manufacturing processes, and transportation processes. Larger and/or smaller system power may be preferred if the design uses a greater fraction of custom, purpose-designed components. Moreover, system power also depends on the end-use of the system. In other words, the size of the system may be affected by whether the system is implemented in the compressor/expander mode or whether the system is being used to deliver only compression or only expansion.

Additionally, the HPU devices according to one or more of the embodiments can be configured to compress a high volume of gas into a lower volume. Devices and systems used to compress and/or expand a gas can be configured to operate in a compression mode to compress fluids up to at least 10,000 psi.

Devices and systems used to compress and/or expand a gas can be configured to operate in an expansion mode to expand a gas such that the compressed gas from the compressed gas storage chamber has a pressure ratio to that of the expanded gas of 250:1. In some embodiments, a compression/expansion device is configured to expand a gas through two or three stages of expansion.

Devices and systems used to compress and/or expand a fluid including air, and gas, and/or to pressurize and/or pump a fluid, such as water, can release and/or absorb heat during, for example, a compression or expansion cycle. In some embodiments, one or more pneumatically or electrically actuated valves can include a heat capacitor for transferring heat to and/or from the gas as it is being compressed/expanded. In some embodiments, the heat transfer element can be a thermal capacitor that absorbs and holds heat released from a gas that is being compressed, and then releases the heat to a gas or other fluid at a later time. In some embodiments, the heat transfer element can be a heat transferring device that absorbs heat from a liquid that is being compressed, and then facilitates the transfer of the heat outside of the device.

In another example, heat can be transferred from and/or to gas that is compressed and/or expanded by adding and/or removing liquid (e.g., water) to/from within a pneumatic cylinder. A gas/liquid or gas/heat element interface may move and/or change shape during a compression and/or expansion process in a pneumatic cylinder. This movement and/or shape change may provide a compressor/expander device with a heat transfer surface that can accommodate the changing shape of the internal areas of a pneumatic cylinder in which compression and/or expansion occurs. This movement and/or shape change may provide a compressor/expander device with a heat transfer surface that optimizes its heat transfer performance with respect to the current conditions within the pneumatic cylinder, for example, with respect to gas density, gas temperature, and/or relative temperature of gas and liquid, among others. In some embodiments, the liquid may allow the volume of gas remaining in a pneumatic cylinder after compression to be nearly eliminated or completely eliminated (i.e., zero clearance volume).

A liquid (such as water or oil or other hydraulic fluids) can have a relatively high thermal capacity as compared to a gas (such as air) such that a transfer of an amount of heat energy from the gas to the liquid avoids a significant increase in the temperature of the gas, but only incurs a modest increase in the temperature of the liquid. This allows buffering of the system from substantial temperature changes. In other words, this relationship creates a system that is resistant to substantial temperature changes. Heat that is transferred between the gas and liquid, or components of the vessel itself, may be moved from or to (for example) a pneumatic cylinder through one or more processes. In some embodiments, heat can be moved in or out of the cylinder using mass transfer of the compression liquid itself. In other embodiments, heat can be moved in or out of the cylinder using heat exchange methods that transfer heat in or out of the compression liquid without removing the compression liquid from the cylinder. Such heat exchangers can be in thermal contact with the compression liquid, components of the cylinder, a heat transfer element, or any combination thereof. Furthermore, heat exchangers may also use mass transfer to move heat in or out of the cylinder. Thus, the liquid within a cylinder can be used to transfer heat from gas that is compressed or compressing (or to gas that is expanded or expanding) and can also act in combination with a heat exchanger to transfer heat to an external environment (or from an external environment). Any suitable mechanism for transferring heat out of the device during compression and/or into the device during expansion may be incorporated into the system.

In some embodiments, a hydraulic actuator includes a hydraulic ram (a component familiar to those skilled in the art of hydraulic actuation) that connects to a pneumatic piston using a piston rod. Piston motion results when a hydraulic pump urges hydraulic fluid into and/or out of a chamber or chambers of the hydraulic ram. Component sizes depend on the power desired for the complete system, on fluid pressures, and on the hydraulic fluid pressures. The fluid pressures in the pneumatic portion of the system, and hydraulic fluid pressure in the hydraulic pump/motor are considered simultaneously in order to configure the relative sizes of hydraulic ram pistons and the pneumatic cylinder pistons. In general, the ratio of the cross sectional area of the hydraulic ram piston, to the cross sectional area of the pneumatic cylinder piston must be in proportion to the ratio of the hydraulic pump/motor operating pressure, to the pneumatic cylinder operating pressure. For example, a hydraulic pump/motor may have a maximum operating pressure of 10,000 psi, if the maximum desired fluid pressure is 2500 psi, then the ratio between hydraulic ram piston cross sectional area to the pneumatic cylinder piston may be no less than 100 divided by 400, and in fact should be greater than this ratio figure in order to overcome machine aspects such as component friction and the like. In addition, the ratio of hydraulic ram piston cross section area to pneumatic piston cross section area can be modified during system operation configuring a hydraulic actuation system with more than one hydraulic ram, a concept which is described in more detail below.

In the present disclosure, the system operation may be controlled by a hydraulic controller and/or electric controller. The controller coordinates: valve actuation, pump/motor operation, fluid direction, and compression/expansion operation. During expansion operation, the controller determines the volume of fluid to admit from a reservoir into the system. By way of example, the controller may collect and evaluate system status information such as the temperatures and pressures of: the fluid storage chambers, cylinders, the fluid source and determine a preferred volume of fluid to admit from the reservoir into or out of the system. The controller may admit a fluid volume calculated to expand such that the fluid achieves a pressure roughly equivalent to the pressure of the fluid source. It is understood that it may be desirable to expand the fluid to pressures that may be greater than, or less than the pressure of the fluid source. The controllers may be used with any of many control paradigms to define overall machine operation such as: a time-based schedule for fluid volume, a time-based schedule for fluid pressure, a time-based schedule for fluid temperature, a parametrically described and controlled position evolution, pressure evolution, temperature evolution, or power consumption/generation. Those skilled in the art of controller design will understand that the possible control algorithms are virtually unlimited.

In some embodiments, one or more hydraulic actuators of a compression/expansion device may incorporate "gear change" or "gear shift" features within a single stage of compression or expansion, or during a cycle or stroke of the actuator, to optimize the energy efficiency of the hydraulic actuation. As used herein, the terms "gear change" or "gear shift" are used to describe a change in the ratio of the pressure of the hydraulic fluid in the active hydraulic actuator chambers to the pressure of the fluid in the working chamber actuated by (or actuating) the hydraulic actuator, which is essentially the ratio of the pressurized surface area of the working piston(s) to the net area of the pressurized surface area(s) of the hydraulic piston(s) actuating the working piston(s). The term "gear" can refer to a state in which a hydraulic actuator has a particular piston area ratio (e.g., the ratio of the net working surface area of the hydraulic actuator to the working surface area of the working piston acting on, or being acted on by, the gas in a working chamber) at a given time period. Examples of suitable hydraulic actuators including "gear changes" or "gear shifts" are described in the '724 application earlier incorporated by reference. The compressor/expander system can also be used with other types of storage, including, but not limited to, tanks, underwater storage vessels, and the like.

The present disclosure also includes the use of one or more pumps to insure a constant volume of fluid remains within the pumps. One such pump is an axial piston type hydraulic pump, and more specifically a hydraulic pump wherein a plurality of pistons are arranged within a liquid tight slidable engagement within cylinders driven for endwise reciprocation by a swash plate. This pump type is known as a "swashplate pump" described in full detail in U.S. Pat. No. 4,007,663. The present disclosure provides a valve plate design for these swashplate pumps that also enables fluid volume to remain constant or nearly constant during operation of the apparatus and system described herein. When needed fluid volume is adjusted by either adding or removing fluid from the apparatus/system/pump by use of the previously described reservoir. By designing the pump with a multi-port valve plate design, it is possible to continuously access the reservoir as needed. This results in reducing the complexity and cost associated with providing the apparatus and system with the required fluid flow and fluid flow path without the need for an inverse shuttle valve (3-port valve plate design) and in some cases without the need for both a detented shuttle valve and an inverse shuttle valve (4-port valve plate design).

While various embodiments of the invention have been described above, it should be understood that they have been presented by way of example only, and not limitation. Where methods and steps described above indicate certain events occurring in certain order, those of ordinary skill in the art having the benefit of this disclosure would recognize that the ordering of certain steps may be modified and that such modifications are in accordance with the variations of the invention. Additionally, certain of the steps may be performed concurrently in a parallel process when possible, as well as performed sequentially as described above. Additionally, certain steps may be partially completed before proceeding to subsequent steps. The embodiments have been particularly shown and described, but it will be understood that various changes in form and details may be made.

Although various embodiments have been described as having particular features and/or combinations of components, other embodiments are possible having any combination or sub-combination of any features and/or components from any of the embodiments described herein.

What is claimed is:

1. A prime mover apparatus that actuates and moves one or more devices that move in either a single or bi-directional direction by utilization of at least one hydraulic power unit(s) (HPU) comprising;

a unit that is powered by hydraulic force such that said HPU utilizes one or more multiport pumps to utilize said hydraulic force, said pumps having at least one inlet port, one outlet port, and one reservoir port that act to balance fluid flow and allow fluid flow in either a clockwise or counterclockwise direction into and out of a pipeline wherein said pipeline has access to at least one reservoir such that said fluid flow enters and exits said one or more multiport pumps from either a designated clockwise (CW) or counterclockwise (CCW) inlet/outlet port such that a clockwise or counterclockwise flow path is created that utilizes said one or more multiport pumps and ensures balanced fluid flow into and out of said apparatus.

2. The prime mover apparatus of claim 1, wherein said one or more pumps are selected from the group consisting of; swashplate pumps, reciprocating pumps, scroll pumps, piston pumps, diaphragm pumps, injection pumps, centrifugal pumps, gear pumps, and metering pumps.

3. The prime mover apparatus of claim 1, wherein said one or more pumps are at least one swashplate pump that includes a multi-port valve plate such that fluid flow into and out of said swashplate pump is either unidirectional or bidirectional, wherein said multi-port valve plate includes at least three ports.

4. The prime mover apparatus of claim 3, wherein said swashplate pump together with said at least three-port valve plate provides for balanced fluid flow maintenance within said pump in that a fluid flow volume must remain constant throughout operation of said swashplate pump and within said pipeline without cavitation of said swashplate pump.

5. The prime mover apparatus of claim 4, wherein said swashplate pump includes a four-port or more valve plate that requires use of an inverse shuttle valve and a detented inverse shuttle valve.

6. The at least four-port valve plate of claim 5, wherein said four-port valve plate provides for a monitor port, wherein said monitor port provides a location for sensors and/or hydraulic actuators.

7. The prime mover apparatus of claim 5, wherein said pump and/or said three-port valve plate with said swashplate pump are immersed in said at least one reservoir.

8. The prime mover apparatus of claim 2, wherein said pumps and/or said swashplate pump allows for fluid flow into and out of said at least one reservoir.

9. The prime mover apparatus of claim 1, wherein said at least one reservoir is vented, sealed, pressure compensated, preloaded and/or expandable.

10. The prime mover apparatus of claim 1, wherein said pumps have three ports that open and close and maintain balanced fluid flow along said flow path by provision of force and direction required to move, control, and/or maintain a position that can be controlled of one or more devices that move.

11. The pumps of claim 5, wherein one of said at least four ports is utilized as a sensor port so that a sensor can be inserted into said sensor port to measure pressure, temperature, and additional fluid parameters within said pumps and said apparatus.

12. The prime mover apparatus of claim 10, wherein fluid is delivered to at least one port within said devices that move and fluid along said flow path from said devices that move is blocked, redirected, or continues to flow into one or more pumps said pumps wherein said pumps control fluid flow returning from said devices that move back into said pumps, thereby completing said flow path and accomplishing an ability to control intermittent or continuous movement of said devices that move.

13. The prime mover apparatus of claim 1, wherein said system includes one or more electrical power unit(s) for actuating and moving one or more devices in either a single or bi-directional direction wherein said electric power unit(s) are selected from the group consisting of pumps, motors, compressors, engines, turbines and inverters.

14. The prime mover apparatus of claim 1, wherein fluid flow along said flow path continues flowing into and out of said pumps thereby keeping one or more pump seals and pump ports filled with fluid so that hydraulic lock and cavitation is eliminated.

15. The prime mover apparatus of claim 1, wherein said apparatus also includes a pressure compensator tank that is operationally connected to a pump inlet port of said pump through a fluid flow filter and wherein said compensator tank is a portion of a variable fluid reservoir.

16. The prime mover apparatus of claim 1, wherein said one or more pumps function as a motor.

17. The prime mover apparatus of claim 1, wherein said fluid reservoir includes at least one compensator tank and a port to ambient pressure and a reservoir pressure measuring device that measures ambient pressure and ensures the ability for said apparatus to operate even in the presence of unbalanced flow to and from said moving device(s) and allows for thermal expansion or compression within said apparatus.

18. The prime mover apparatus of claim 1, wherein said apparatus is a closed system in that said pipeline is completely closed and has no open ports to the atmosphere.

19. The prime mover apparatus of claim 1, wherein said apparatus is an open system in that said pipeline has at least one port that is opened to the atmosphere.

20. The prime mover apparatus of claim 1, wherein a controller is utilized to increase volume, change direction, and/or increase kinetic energy per unit volume of a fluid static or dynamic pressure within said fluid along said flow path.

21. The prime mover apparatus of claim 1, wherein fluid within said fluid reservoir is controlled by a controller.

22. The prime mover apparatus of claim 1, wherein fluid reaches an upper bi-directional port of said devices that move and is delivered to said devices that move and returns from said devices that move into a lower bi-directional port.

23. The prime mover apparatus of claim 1, wherein said apparatus includes components that contain at least one valve and wherein said valve is a check valve and wherein said check valve has two ports.

24. The prime mover apparatus of claim 1, wherein said apparatus includes components that contain at least one set of pilot operated check valves and wherein said pilot operated check valves have at least three ports.

25. The prime mover apparatus of claim 1, wherein said apparatus includes components that contain at least two sets of pilot operated check valves.

26. The prime mover apparatus of claim 1, wherein said apparatus includes components that contain one or more valves that is a detented shuttle valve with at least three ports.

27. The prime mover apparatus of claim 1, wherein said apparatus contains one or more valves that is an inverted shuttle valve with at least three ports.

28. The prime mover apparatus of claim 1, wherein said pipeline has at least one fluid flow filter.

29. The prime mover apparatus of claim 1, wherein said pipeline has at least one pressure measuring device.

30. The prime mover apparatus of claim 1, wherein said one or more devices that move includes a group consisting of;

mechanical devices, electro-mechanical devices, and electro-hydraulic devices.

31. The prime mover apparatus of claim 1, wherein said one or more devices that move are valves, gate valves, ball valves, seat valves, flapper valves, rotary valves, sleeve valves, packers, gears, hydraulic cylinders, hydraulic rotary actuators, bladders, accumulators, and reservoirs.

32. The prime mover apparatus of claim 31, wherein flow control elements include valves selected from the group consisting of: shuttle valves, inverted shuttle valves, inverse shuttle valves, detented shuttle valves, inverted detented shuttle valves, check valves, pilot check valves, solenoid valves, servo valves, ball valves, and gate valves.

33. The prime mover apparatus of claim 32, wherein said valves are part of a fluid circuit and are provided in parallel, in series, or in any combination of parallel and series throughout said system so that said apparatus is operational in that fluid can travel in either a unidirectional and/or bi-directional flow path through said apparatus and so that fluid powers devices that operate in either a singular or bi-directional manner.

34. The prime mover apparatus of claim 1, wherein said hydraulic power unit (HPU) moves a prime mover by using energy to move fluid in a flow path.

35. The prime mover apparatus of claim 1, wherein said hydraulic power unit (HPU) maintains pressure required to lock a position of said moving devices and maintains pressure utilizing one or more check valves.

36. The prime mover apparatus of claim 35, wherein said hydraulic power unit (HPU) does not maintain pressure when said apparatus is intentionally or unintentionally not receiving energy so that said pumps are no longer functioning in a forward direction but are able to function in a reverse direction such that pressure that acts on said moving devices is released and reduced to greater than or equal to zero such that said devices that move can reach and reside in any desired static position.

37. The prime mover apparatus of claim 1, wherein said hydraulic power unit (HPU) extracts hydraulic energy in a form of hydraulic power from a flow path to an external energy sink.

38. The prime mover apparatus of claim 1, wherein said prime mover apparatus is a flow measuring device.

* * * * *